US011684184B2

(12) United States Patent
Hansen

(10) Patent No.: US 11,684,184 B2
(45) Date of Patent: Jun. 27, 2023

(54) PROTECTION GUARD HAVING MOVEABLE AND POSITIONABLE SHIELD USEFUL FOR FOOD STATIONS IN THE FOOD SERVICE INDUSTRY

(71) Applicant: THE VOLLRATH COMPANY, L.L.C., Sheboygan, WI (US)

(72) Inventor: Brandon M. Hansen, Hastings, MN (US)

(73) Assignee: THE VOLLRATH COMPANY, L.L.C., Sheboygan, WI (US)

( * ) Notice: Subject to any disclaimer, the term of this patent is extended or adjusted under 35 U.S.C. 154(b) by 583 days.

(21) Appl. No.: 16/533,306

(22) Filed: Aug. 6, 2019

(65) Prior Publication Data

US 2020/0046146 A1 Feb. 13, 2020

Related U.S. Application Data

(60) Provisional application No. 62/717,114, filed on Aug. 10, 2018.

(51) Int. Cl.
*A47F 10/06* (2006.01)

(52) U.S. Cl.
CPC ..... *A47F 10/06* (2013.01); *A47F 2010/065* (2013.01)

(58) Field of Classification Search
CPC .... A47F 10/06; A47F 2010/065; A47F 3/005; A47F 9/00; A47F 2003/008; A47F 3/007; A47F 3/12; A47F 3/06; A47F 3/0434; A47F 3/004; A47F 5/12; A47B 57/04; A47B 96/062; A47B 2200/0044; A47B 2200/0042
See application file for complete search history.

(56) References Cited

U.S. PATENT DOCUMENTS 443,350 A 12/1890 Barners
827,950 A 8/1906 Zimmer
(Continued)

FOREIGN PATENT DOCUMENTS

CA 2153439 A1 1/1996
CN 204704255 10/2015
(Continued)

OTHER PUBLICATIONS

PMG Premier Metal & Glass, Self Serve Sneeze Guards, https://www.pmg-inc.com/self-serve-sneeze-guards, viewed Jun. 14, 2018, 1 pg.

(Continued)

*Primary Examiner* — Hiwot E Tefera
(74) *Attorney, Agent, or Firm* — Foley & Lardner LLP

(57) ABSTRACT

The present invention provides protective enclosures and food and/or beverage stations with these enclosures in which one or more of the side panels are easily raised and lowered and easily fixed in one or more positions as desired. For example, side panels can be easily lowered or closed or easily raised and fixed in one or more open configurations. The present invention is based at least in part on a coupling system that pivotably and slideably couples the moveable and positionable side panels to the protective enclosure. The coupling system uses a system of coordinated slots that cooperatively guide the movement of the side panel in its range of motion.

21 Claims, 16 Drawing Sheets

(56) References Cited

U.S. PATENT DOCUMENTS 1,023,789 A 4/1912 Miller
1,075,334 A 10/1913 Cobb
1,288,665 A 12/1918 Page
1,358,262 A 11/1920 Sumner
1,431,371 A 10/1922 Chapman
1,644,675 A 12/1925 Huening
1,705,237 A * 3/1929 Elvah ..... A47F 5/12 248/242
1,725,867 A 8/1929 Kennedy
2,767,003 A 10/1956 Gilmont
3,426,993 A * 2/1969 Oskar ..... A47B 57/045 248/242
3,554,416 A 1/1971 Bott
3,561,713 A * 2/1971 Berkowitz ..... A47B 57/045 211/100
3,795,379 A * 3/1974 Gray ..... A47B 96/07 248/242
3,921,539 A * 11/1975 Berger ..... A47F 5/12 108/106
4,216,844 A 8/1980 Klafs
4,230,414 A 10/1980 Cheshire
4,448,337 A 5/1984 Harlow et al.
4,469,261 A 9/1984 Stapleton et al.
4,500,020 A 2/1985 Rasor
4,506,408 A 3/1985 Brown
4,608,773 A 9/1986 White
4,658,983 A 4/1987 Suttles
4,660,885 A 4/1987 Suhr et al.
4,662,114 A 5/1987 Suttles
D293,985 S 2/1988 White
4,757,769 A 7/1988 Suttles
D297,490 S 9/1988 Suttles
4,773,543 A 9/1988 Suttles et al.
D298,596 S 11/1988 Suttles
4,829,611 A 5/1989 Fireman et al.
D301,665 S 6/1989 Suttles
D302,221 S 7/1989 Suttles et al.
4,852,954 A 8/1989 Brown et al.
D303,190 S 9/1989 Suttles
D304,535 S 11/1989 White
4,881,660 A 11/1989 Suttles
4,909,491 A * 3/1990 Cheng ..... B25H 1/18 269/220
4,915,334 A 4/1990 White
D309,540 S 7/1990 Suttles et al.
D311,837 S 11/1990 Suttles
D314,876 S 2/1991 Suttles
D324,737 S 3/1992 Stafford
D337,462 S 7/1993 LaVaute et al.
5,664,268 A 9/1997 Stoler et al.
5,699,614 A 12/1997 Garneau, Sr.
5,749,480 A * 5/1998 Wood ..... A47B 57/04 248/242
6,115,921 A 9/2000 Garneau, Sr.
6,132,018 A 10/2000 McGrath
6,267,111 B1 7/2001 Burton
6,290,025 B1 9/2001 Lynn et al.
6,343,406 B1 2/2002 Yeh
6,390,424 B1 5/2002 Kidushim et al.
6,421,921 B1 7/2002 Garneau, Sr.
6,485,118 B2 * 11/2002 Matus, Jr. ..... A47F 9/00 312/137
D472,083 S 3/2003 English et al.
6,588,863 B1 7/2003 Yatchak et al.
6,612,124 B1 9/2003 Hatch et al.
D497,739 S 11/2004 English et al.
7,040,723 B2 * 5/2006 Matus, Jr. ..... A47F 10/06 312/137
7,067,773 B2 6/2006 Dewitt
7,210,742 B2 5/2007 Wu
D543,780 S 6/2007 Myers et al.
D575,560 S 8/2008 English
7,631,575 B2 12/2009 Gard et al.
7,640,696 B2 1/2010 Yingst
7,784,398 B2 8/2010 Matus, Jr.
7,895,953 B2 3/2011 Matus, Jr.
7,958,673 B2 6/2011 Yingst et al.
D649,865 S 12/2011 English et al.
8,109,579 B2 * 2/2012 English ..... A47F 10/06 312/137
8,112,920 B2 2/2012 Fenton
8,128,306 B2 3/2012 Gorza
8,302,919 B1 11/2012 McGrath
8,308,249 B2 11/2012 Matus, Jr.
8,403,430 B2 3/2013 Atkins
8,544,112 B2 10/2013 Gosine
8,585,160 B2 11/2013 Atkins
8,671,618 B2 3/2014 Yingst et al.
8,701,323 B2 4/2014 Fenton
8,898,862 B1 12/2014 McGrath
8,925,153 B1 1/2015 McGrath
8,925,172 B2 1/2015 English
8,973,876 B1 3/2015 McGrath
9,010,883 B2 4/2015 Scott
9,062,483 B1 6/2015 McGrath
9,144,329 B1 9/2015 McGrath
9,153,147 B2 10/2015 Fenton
9,161,639 B1 10/2015 Hundley et al.
9,249,827 B2 2/2016 Serocki et al.
9,291,188 B2 3/2016 English
D756,759 S 5/2016 Atkins et al.
9,326,621 B1 5/2016 McAllister et al.
9,339,131 B1 5/2016 Christianson
9,399,882 B1 7/2016 McGrath
9,516,958 B1 12/2016 McAllister et al.
9,538,868 B1 1/2017 Christianson
9,557,004 B1 1/2017 Mcgrath
9,723,935 B1 8/2017 Mcallister et al.
9,777,521 B2 10/2017 Edavana et al.
9,782,022 B2 10/2017 Atkins et al.
9,839,306 B2 12/2017 Atkins et al.
10,024,090 B2 7/2018 Tazbaz et al.
10,047,789 B1 8/2018 Mosby et al.
10,058,198 B2 8/2018 Atkins et al.
10,058,199 B1 8/2018 Perry
10,100,571 B2 10/2018 Deman
10,102,780 B2 10/2018 Fenton
10,159,363 B1 12/2018 Mcallister et al.
10,174,534 B2 1/2019 Tazbaz et al.
10,180,022 B1 1/2019 Garg et al.
10,223,985 B2 3/2019 Staton et al.
10,292,506 B2 5/2019 Matus, Jr.
10,405,677 B2 9/2019 Cummings et al.
10,413,097 B2 9/2019 Matus, Jr.
10,415,285 B1 9/2019 Anderson et al.
10,546,517 B2 1/2020 Fenton
10,750,887 B2 8/2020 Atkins et al.
10,765,236 B2 9/2020 Quinter et al.
10,767,405 B1 9/2020 Anderson et al.
10,799,043 B2 10/2020 Quinter
10,818,250 B2 10/2020 Staton et al.
10,986,943 B2 4/2021 Quinter
11,129,484 B2 9/2021 Scott
2002/0096976 A1 * 7/2002 Matus, Jr. ..... A47F 9/00 312/137
2003/0047086 A1 * 3/2003 Matus, Jr. ..... A47F 10/06 99/485
2003/0057810 A1 3/2003 Dewitt
2004/0226903 A1 11/2004 Wang
2005/0061585 A1 * 3/2005 Yingst ..... A47F 3/007 186/38
2006/0163976 A1 * 7/2006 Matus ..... A47F 10/06 312/140.4
2006/0175940 A1 8/2006 English
2006/0192467 A1 8/2006 Matus
2007/0236112 A1 10/2007 Williman
2009/0224583 A1 9/2009 Nagura et al.
2010/0045149 A1 * 2/2010 English ..... A47B 96/062 312/140.4
2011/0080075 A1 * 4/2011 Matus, Jr. ..... A47F 3/12 312/140.4
2011/0169384 A1 7/2011 Padden et al.
2012/0200207 A1 8/2012 Atkins

(56) References Cited

U.S. PATENT DOCUMENTS

| | | | | |
|---|---|---|---|---|
| 2014/0366751 | A1 | 12/2014 | Atkins et al. | |
| 2015/0289641 | A1 | 10/2015 | Ergun et al. | |
| 2016/0073795 | A1 | 3/2016 | Matus, Jr. | |
| 2016/0331155 | A1 | 11/2016 | Atkins et al. | |
| 2018/0242760 | A1 | 8/2018 | Cummings et al. | |
| 2019/0110588 | A1 | 4/2019 | Wong | |
| 2019/0110613 | A1* | 4/2019 | Charlier | A47F 10/06 |
| 2019/0110614 | A1 | 4/2019 | Charlier et al. | |
| 2019/0128034 | A1 | 5/2019 | Luedtke | |
| 2019/0150640 | A1 | 5/2019 | Scott | |
| 2019/0350386 | A1 | 11/2019 | Cummings et al. | |
| 2020/0046146 | A1 | 2/2020 | Hansen | |
| 2020/0245789 | A1* | 8/2020 | Hansen | E05D 11/06 |

FOREIGN PATENT DOCUMENTS

| | | | | |
|---|---|---|---|---|
| DE | 10320528 | A1 * | 12/2004 | A47F 3/007 |
| FR | 2504216 | B3 | 2/1984 | |
| JP | 2007-159882 | A | 6/2007 | |
| JP | 2011-012750 | A | 1/2011 | |

OTHER PUBLICATIONS

BSI Designs: Food Guards, http://www.bsidesigns.com/products/food-guards, viewed Jun. 14, 2018, 2 pgs.

Versa Gard, Food Protection System, Sneeze Guards, http://versagard.com, viewed Jun. 14, 2018, 1 pg.

Woodsmith Plans, Designer Series Project, Craftsman-style Futon Sofa Bed, WoodsmithPlans.com (WS15226), Aug. 2012 Home Publishing Co., pp. 1-8.

Mark Johnson, Workshop, Finer Futon Frame, Not just for dorm rooms anymore, Handy, Mar./Apr. 2002, viewed Dec. 9, 2014, pp. 10 and 12-16.

BSI: DECO Engineered Food Shields, Model: DECO-250-N, Apr. 30, 2017 (Apr. 30, 2017), XP055544067, Retrieved from the Internet: URL:https://assetcloud.roccommerce.net//files/_singer/4/10/8/10004447_spec_sheet.pdf.

International Search Report and Written Opinion of the International Searching Authority for PCT/US2018/000384 dated Jan. 28, 2019.

Stepless adjustment for angular position 2, https://www.youtube.com/watch?v=-ip9PIJ7z5Q uploaded on Jun. 19, 2019, 23 pages.

* cited by examiner

PROTECTION GUARD HAVING MOVEABLE AND POSITIONABLE SHIELD USEFUL FOR FOOD STATIONS IN THE FOOD SERVICE INDUSTRY

PRIORITY

The present application claims priority to U.S. Provisional Patent Application No. 62/717,114 filed Aug. 10, 2018, the entire contents of which is incorporated herein by reference it its entirety for all purposes.

FIELD OF THE INVENTION

The present invention relates to food stations used in the food service industry to serve food and beverage items on a self-serve basis to patrons, wherein the food tables include protective enclosures around the food and beverage items to help provide protection against airborne contamination. More specifically, the present invention relates to such food stations and protective enclosures in which the protective enclosure has a moveable and positionable shield that is pivotably and slideably coupled to a support structure to allow the shield to be easily raised and lowered and fixed into one or more desired positions.

BACKGROUND OF THE INVENTION

The food service industry uses food stations to present and serve food and beverage items. Multiple food stations often are used in combination in situations such as self-serve buffets, restaurant dining rooms, cafeteria-style serving facilities, catered events, and the like. A typical food station includes a base cabinet that may be on casters or other similar hardware to allow the station to be more easily moved to different locations or positions. The base cabinet is fitted with a countertop on which food and/or beverages as well as related meal utensils may be presented for consumption or use by patrons. Some food stations have one or more wells that hold pans of food. Eating utensils, and other meal related items also may be presented on a food station. Food stations also may include cooling or heating components to serve cold or hot food or beverages. To power heating and cooling components, food stations may include power supplies or components that allow the food station to be connected to power supplies. Some stations may include plumbing components to couple the station to a water supply and/or to drains.

Food stations may be set up for self-serve functionality in which a patron selects and serves his or her own food or beverages from the station. Self-serve stations may be single-sided so that patrons accomplish self-service from only one side of the station. Other food stations are configured to allow self-service from two or more sides of the station. Other food stations, such as those in cafeterias, allow the patrons to view and select food or beverage items, but it is service personnel who then serve the selections.

According to applicable food service regulations in many venues, a protective enclosure often is mounted over the countertop and food/beverage supplies of a food station to protect against airborne contamination. These protective enclosures are also known in the food service industry as sneeze guards or breath guards. A typical protective enclosure used on self-serve food stations includes a top panel, and one or more side panels. Side panels often are included on the ends of the food station as well as on the side(s) on which patrons interact with the food station. The sides used by food service personnel optionally may include a side panel, but often do not. As used herein, a side panel that is deployed on the side(s) of a food station accessible to patrons will be referred to as a front panel or shield.

A typical front panel is transparent so that the items presented on the station can be easily viewed through the panel. For self-serve situations ("self-serve mode"), the front panel or shield is deployed in a raised configuration so that it protects the food supply while still allowing the patron to reach under the panel to access the food supply. If a station allows self-serve access from two or more sides of the station, each such side is configured with a similar, raised shield panel. In contrast to self-serve situations, a typical front panel used on some foods stations ("served mode") is fully lowered so that patrons can view and select food choices, but the patrons or served and cannot directly access food choices for self-service.

It would be desirable if a protective enclosure allows one or more of the side panels of a protective enclosure, including but not limited to the front panels, to be easily raised and lowered. It also is desirable if the side panels could be set in multiple fixed positions as desired. For example, a configuration is desired in which a side panel would be lowered to block access to the food station from that side. This can be done to close the station or to convert the station from a self-serve mode to a served mode. Another configuration also is desired in which that same side panel could be raised and fixed in one or more raised positions to allow self-serve access by patrons or access by food service personnel for maintenance, upkeep, or service.

SUMMARY OF THE INVENTION

The present invention provides protective enclosures and food stations with these enclosures in which one or more of the side panels are easily raised and lowered and easily fixed in one or more positions as desired. For example, side panels can be easily lowered or closed or easily raised and fixed in one or more open configurations. The present invention is based at least in part on a coupling system that pivotably and slideably couples the moveable and positionable side panels to the protective enclosure. The coupling system uses a system of coordinated slots that cooperatively guide the movement of the side panel in its range of motion.

The slot system allows the side panel to serve as its own counterweight while being raised or lowered, making the side panel easier to move and deploy. For example, when a side panel is opened from a closed configuration or closed from an open configuration, one edge of the panel is being raised while the opposite edge is being lowered. In practical effect, the counter movement provides a degree of mechanical leverage when moving the panel, reducing its apparent weight.

In a first aspect, the present invention relates to a protection system, preferably a food protection system, comprising:

a) a support structure;

b) a protective enclosure comprising a moveable and positionable shield, said moveable and positionable shield comprising a first shield end and a second shield end, wherein each of the first and second shield ends is slideably and pivotably coupled to the support structure in a manner such that the moveable shield comprises a range of motion in which the shield slides and pivots to be raised and lowered in a range of motion that comprises two or more stationary positions comprising at least a lowered shield position and a raised shield position;

c) a first bracket assembly that slideably and pivotably couples the first shield end to the support structure; and d) a second bracket assembly that slideably and pivotably couples the second shield end to the support structure;

wherein each of the first and second bracket assemblies comprises first and second slots that cooperatively guide corresponding first and second bearing surfaces in a manner such that raising a first edge of the moveable and positionable shield results in a countermove lowering of a second edge of the moveable and positionable shield effective to reduce the apparent weight of the moveable shield.

In a second aspect, the present invention relates to a food station comprising:

a) a countertop;

b) a base supporting the countertop; and c) a food protection system according to the first aspect that is incorporated into the food station in a manner such that the protective enclosure provides a barrier between the countertop and at least a portion of the ambient environment.

In a third aspect, the present invention relates to a protection system, preferably a food protection system, comprising:

a) a support structure;

b) a protective enclosure comprising a moveable and positionable shield, said moveable and positionable shield comprising a first shield end and a second shield end, wherein each of the first and second shield ends is slideably and pivotably coupled to the support structure in a manner such that the moveable shield comprises a range of motion in which the shield slides and pivots to be raised and lowered in a range of motion that comprises two or more stationary positions;

c) a first bracket assembly that slideably and pivotably couples the first shield end to the support structure; and d) a second bracket assembly that slideably and pivotably couples the second shield end to the support structure; and wherein each of the first and second bracket assemblies comprises first and second slots that cooperatively guide corresponding first and second bearing surfaces.

In a fourth aspect, the present invention relates to a food station comprising:

a) a countertop;

b) a base supporting the countertop; and c) a food protection system according to the third aspect that is incorporated into the food station in a manner such that the protective enclosure provides a barrier between the countertop and at least a portion of the ambient environment.

In a fifth aspect, the present invention relates to a protection system, preferably a food protection system, comprising:

a) a support structure;

b) a protective enclosure comprising a moveable and positionable shield, said moveable and positionable shield comprising a first shield end and a second shield end, wherein each of the first and second shield ends is slideably and pivotably coupled to the support structure in a manner such that the moveable shield comprises a range of motion in which the shield slides and pivots to be raised and lowered in a range of motion that comprises two or more stationary positions comprising at least a lowered shield position and a raised shield position;

c) a first bracket assembly that slideably and pivotably couples the first shield end to the support structure; and d) a second bracket assembly that slideably and pivotably couples the second shield end to the support structure; and wherein each of the first and second bracket assemblies comprises a first bracket attached to the support structure and a shield bracket attached to the moveable and positionable shield, wherein the first bracket comprises first and second slots and the shield bracket comprises first and second bearing surfaces; and wherein:

i) the first slot slideably and pivotably engages the first bearing surface in a manner effective to slideably and pivotably guide a rearward portion of the moveable and positionable shield, and wherein the first slot includes a first slot axis that is sloped downward at an angle relative to a horizontal reference line; and ii) the second slot slideably and pivotably engages the second bearing surface in a manner effective to slideably and pivotably guide a leading portion of the moveable and positionable shield, and wherein the second slots comprises first and second slot legs acutely joined proximal to the top of the first slot leg at an apex, wherein the first slot leg is substantially vertical and the second slot leg has a second slot leg axis that is sloped downward relative to the horizontal reference line more steeply than the first slot axis.

In a sixth aspect, the present invention relates to a food station comprising:

a) a countertop;

b) a base supporting the countertop; and c) a food protection system according to the fifth aspect that is incorporated into the food station in a manner such that the protective enclosure provides a barrier between the countertop and at least a portion of the ambient environment.

BRIEF DESCRIPTION OF THE DRAWINGS

FIG. 10 is a front view showing the end panel assembly of FIG. 9 viewed edge on.

DETAILED DESCRIPTION OF PRESENTLY PREFERRED EMBODIMENTS

Figure 2:
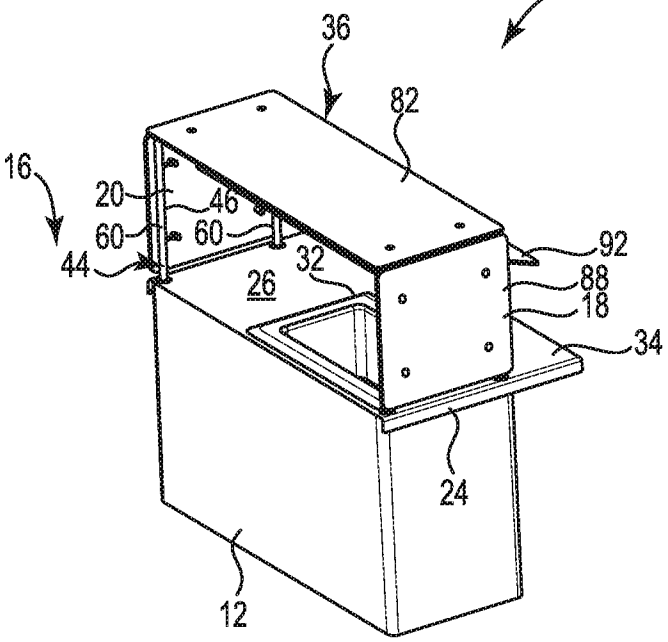
FIG. 2 is a rear perspective view of the self-serve food station of FIG. 1.

The present invention will now be further described with reference to the following illustrative embodiments. The embodiments of the present invention described below are not intended to be exhaustive or to limit the invention to the precise forms disclosed in the following detailed description. Rather a purpose of the embodiments chosen and described is so that the appreciation and understanding by others skilled in the art of the principles and practices of the present invention can be facilitated.

A representative embodiment of a food station 10 (also referred to in the food service industry as a buffet station or food table) of the present invention is shown in FIG. 1 through 30. In practice, even though a single food station 10 is shown in the figures, multiple units of the food station 10 may be deployed in one or more rows or sections in order to present a more complete buffet selection of food items to patrons. Food station 10 is of the type that allows self-serve patron access to one or more food supplies held in food station 10. For purposes of illustration, food station 10 is a single-sided embodiment in the sense that self-serve patron access the food station 10 from a front side 14. Access to the food supply from a rear side 16 may be blocked and/or limited only to designated service personnel such as to serve, clean, service, or maintain the food station 10 or its food supply(ies). Other embodiments of food station 10 may be configured so that patrons may access one or more food supplies from either the front and/or rear sides 14 and 16 and/or even from one or both sides 18 and/or 20 of food station 10.

Referring now mainly to FIGS. 1 to 5, food station 10 includes a base in the form of enclosed base cabinet 12 which optionally may be used for a variety of purposes such as to store food station supplies and/or to house functional food station components such as drains or other plumbing, refrigeration components, lighting, heating, sensors such as temperature sensors or food or beverage level sensors, electrical power components, and the like. Optionally, base cabinet 12 may be fitted with casters (not shown) or other mobility devices to allow food station 10 to be more easily moved to different locations or positions. Such mobility devices may be lockable to prevent mobility once food station 10 is located or positioned in a desired manner.

Food station 10 includes countertop 24 mounted onto base cabinet 12. Countertop 24 includes upper surface 26 and one or more wells holding food supplies (not shown) in corresponding pans 32. For purposes of illustration, countertop 24 is configured with a single pan 32. Such an embodiment provides more room on upper surface 26 to store some items, such as some food items, serving tools, eating utensils, food toppings, or the like that do not need to be deployed in pans. Other embodiments may include two or more pans or other serving containers and corresponding food supplies. For example, such other embodiments may include from 2 to 8 sets of pans and food supplies held in corresponding countertop wells.

Countertop 24 also includes extending portion 34 that overhangs relative to base cabinet 12. Extending portion 34 provides a convenient working surface to use while interacting with food station 10. For example, a patron may use the extending portion 34 to support a food tray onto which the patron places food items from a food supply held in pan 32. Alternatively, service personnel may use extending portion 34 to hold items used to service or maintain food station 10.

Referring now mainly to FIGS. 1 through 13, food station 10 includes a food protection system in the form of protective enclosure 36 that helps to protect food supply from contamination, particularly airborne contamination. In the food service industry, protective enclosure 36 also is known as a "breath guard" or "sneeze guard" system. As main components, protective enclosure 36 includes support structure 44, top panel 82, side panels 88, moveable and positionable shield, 92, and a coupling system 110 that slideably and pivotably couples shield 92 to the protective enclosure 36. Accessories for food station 10, such as heaters, lights, fans, filters, and the like may be mounted onto protective enclosure 36 as an option. For purposes of illustration, heater 86 (see FIGS. 5 and 8) is attached to an underside of top panel 82 to help keep food supply warm.

Support structure 44 includes leg assemblies 46 on each side of protective enclosure 36. Each leg assembly 46 is identical to the other except for being mirror images of each other. Accordingly, details described with respect to one leg assembly 46 are also applicable to the other leg assembly 46 with this understanding.

Each leg assembly 46 generally includes a cross beam 48, legs 60, pins 50 and mounting members in the form of standoffs 52 associated with attachment to top panel 82, and pins 72 and mounting members in the form of standoffs 74 associated with attachment to side panels 88. Note that moveable and positionable shield 92 is coupled to the support structure 44 by the coupling system 110 described further below.

Pins 50 extend inward from cross beam 48 toward the interior of the protective enclosure 36. Pins 50 may be integrally formed with cross beam 48 or may be attached via a suitable attachment technique such as welding, brazing, gluing, bolting, threaded engagement, riveting, snap-fit engagement, and/or the like. Standoffs 52 are mounted onto the ends of pins 50 and provide attachment sites for top panel 82. Any suitable attachment technique may be used. For example, mounting hardware such as bolts, rivets, or machine screws and associated washers may be used to attach top panel 82 to the standoffs 52. Top panel 82 includes corresponding mounting apertures to accommodate such fasteners.

Legs 60 are attached to the ends of the corresponding cross beam 48. Legs extend from base 62 to top end 64. A flange or escutcheon 66 is positioned on each leg 60 between the base 62 and top end 64 in order to help mount each leg to countertop 24. A lower portion 68 of each leg 60 extends downward through countertop 24 below escutcheon 66. An upper portion 70 of each leg 60 extends upward above countertop 24 from escutcheon 66. Escutcheons 66 allow for adjustment of the height of upper portions 70 so that the height of the access to the food supply can be adjusted as desired. The figures show legs 60 attached to countertop 24 with using a through counter attachment technique. Other attachment techniques can be used. For example, the legs 60 may be attached directly to upper surface 26 without penetrating into or through countertop 24.

Pins 72 extend inwardly from each leg 60 in a direction generally parallel to side panels 88 and thus in the main plane of the leg assemblies 46. Pins 72 may be integrally formed with legs 60 or may be attached via a suitable attachment technique such as welding, brazing, gluing, bolting, threaded engagement, riveting, snap-fit engagement, and/or the like. Standoffs 74 are mounted onto the ends of pins 72 and provide attachment sites for each corresponding side panel 88. Any suitable attachment technique may be used. For example, mounting hardware such as bolts, rivets, or machine screws and associated washers may be used to attach side panel 88 to the standoffs 74. Each side panel 88 includes corresponding mounting apertures to accommodate such fasteners.

Moveable and positionable shield 92 is slideably and pivotably coupled to the support structure 44 of protective enclosure 36 in a manner such that the moveable and positionable shield 92 comprises a range of motion in which the shield 92 slides and pivots to be raised and lowered in a range of motion that comprises two or more stationary positions. The shield 92 is moveable in the sense that the shield 92 can move through the range of motion. The shield 92 is positionable in the sense that the shield 92 can be positioned into two or more fixed positions within the range of motion. Often, such stationary positions comprise at least a lowered shield position and at least one raised shield position. In the lowered position, access to a food supply is blocked. This closed configuration may be desired in a variety of circumstances such as when food station 10 is closed or when, instead of the self-service option, a service provider such as a chef serves food from station 10 to a patron according to a served mode configuration. An open configuration may be desired in a variety of circumstances such as to allow self-serve access to food by a patron or to allow service access to the inside of the protective enclosure 36 from the front side 14. The coupling system 110 and the operation of moveable and positionable shield 92 are described further below.

As seen best in FIGS. 1 to 13, moveable and positionable shield 92 includes an outer face 94 and an inner face 96. Outer face 94 generally faces outward from the inside of protective enclosure 36 while inner face 96 generally faces inward toward the inside of protective enclosure 36. Moveable and positionable shield 92 further includes a first end 98 proximal to a corresponding first leg assembly 46 and a second end 100 that is proximal to a corresponding second leg assembly 46. Moveable and positionable shield 92 includes leading or front edge 102 extending from first end 98 to second end 100. Edge 102 is leading or towards the front in the sense that this edge 102 is closest to the user on the front side 14 of station 10 that is guarded by the shield 92 when shield 92 is in an open configuration. Edge 102 also leads the motion of shield 92 when shield 92 is lowered into a closed configuration. Moveable and positionable shield 92 includes trailing or rear edge 104 extending from first end 98 to second end 100. Edge 104 is trailing or towards the rear in the sense that this edge 104 is closer to the rear side 16 of station 10 when the shield 92 is in an open configuration. Edge 104 also trails the motion of shield 92 when shield 92 is lowered into a closed configuration. Moveable and positionable shield 92 also includes suitable mounting apertures through the faces 94 and 96. These mounting apertures accommodate hardware 95 used to attach shield to the coupling system 110. Similar apertures and hardware are used with respect to top panel 82 and side panels 88.

Each of panels 82 or 88, or shield 92, can be made from a wide range of materials such as glass materials, polymer materials, and the like. Desirably, one or more of these are transparent to allow the contents of food station 10 to be viewed through the panels or shield. In on suitable embodiment, one or more of panels 82 or 88, or shield 92 are made from tempered glass, preferably ⅜ inch thick tempered glass.

Coupling system 110 is shown throughout the Figures, but is shown in the most detail in FIGS. 12 through 22, and 27 to 30. Coupling system 110 in the form of bracket assemblies 111 is used to slideably and pivotably couple the positionable and moveable shield 92 to the protective enclosure 36. In this embodiment, coupling system couples the bracket assemblies 111 to the support structure 44, although other embodiments may involve coupling to other enclosure components such as top panel 82 and/or side panels 88. One bracket assembly 111 connects first end 98 of shield 92 to the support structure 44. Another bracket assembly 111 connects second end 100 of shield 92 to the support structure 44. Each bracket assembly 111 is identical to the other except for being mirror images of each other. Accordingly, details described with respect to bracket assembly 111 are also applicable to the other bracket assembly 111 with this understanding.

Each bracket assembly 111 generally includes a first bracket in the form of slotted hinge bracket 112 and a second bracket in the form of shield bracket 174. Slotted hinge bracket 112 is attached to support structure 44 and includes slot features (described further below) that help to guide moveable and positionable shield 92 through its range of motion. These features include functionality that also helps to hold shield 92 in fixed positions including at least one lowered configuration to at least partially block access to the interior of the protective enclosure 36 and at least one raised or open configuration that allows access to the interior of the protective enclosure 36. Shield bracket 174 is attached to the moveable and positionable shield 92 and further incorporates at least one bearing surface that slideably and pivotably engages the slot features of the slotted hinge bracket 111.

Figure 15:
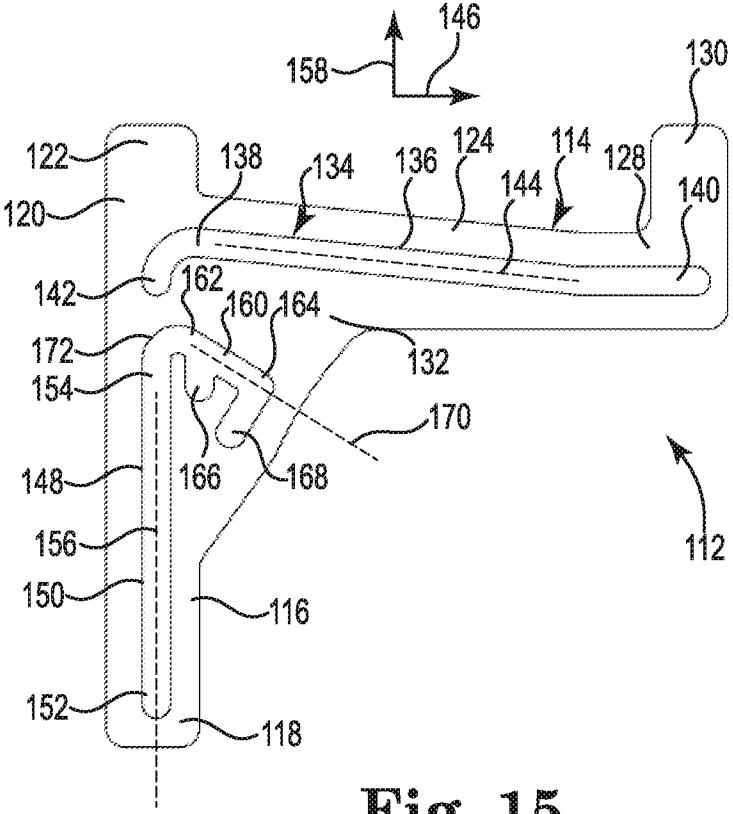
FIG. 15 is a side view of the slotted hinge bracket of FIG. 15.
Figure 14:
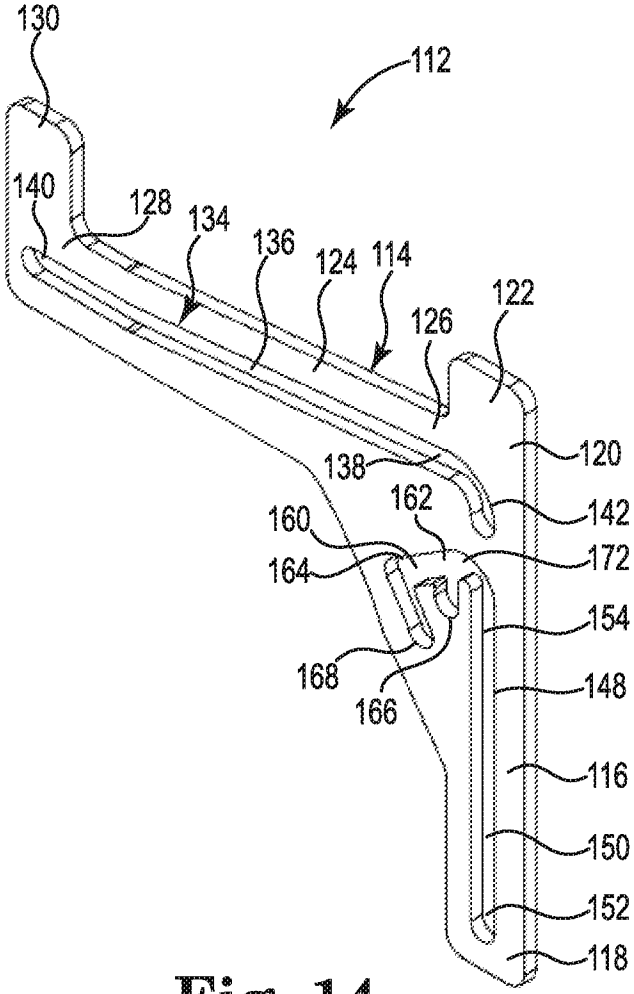
FIG. 14 is a perspective view of a slotted hinge bracket used in each of the bracket assemblies of FIG. 12.
Figure 16:
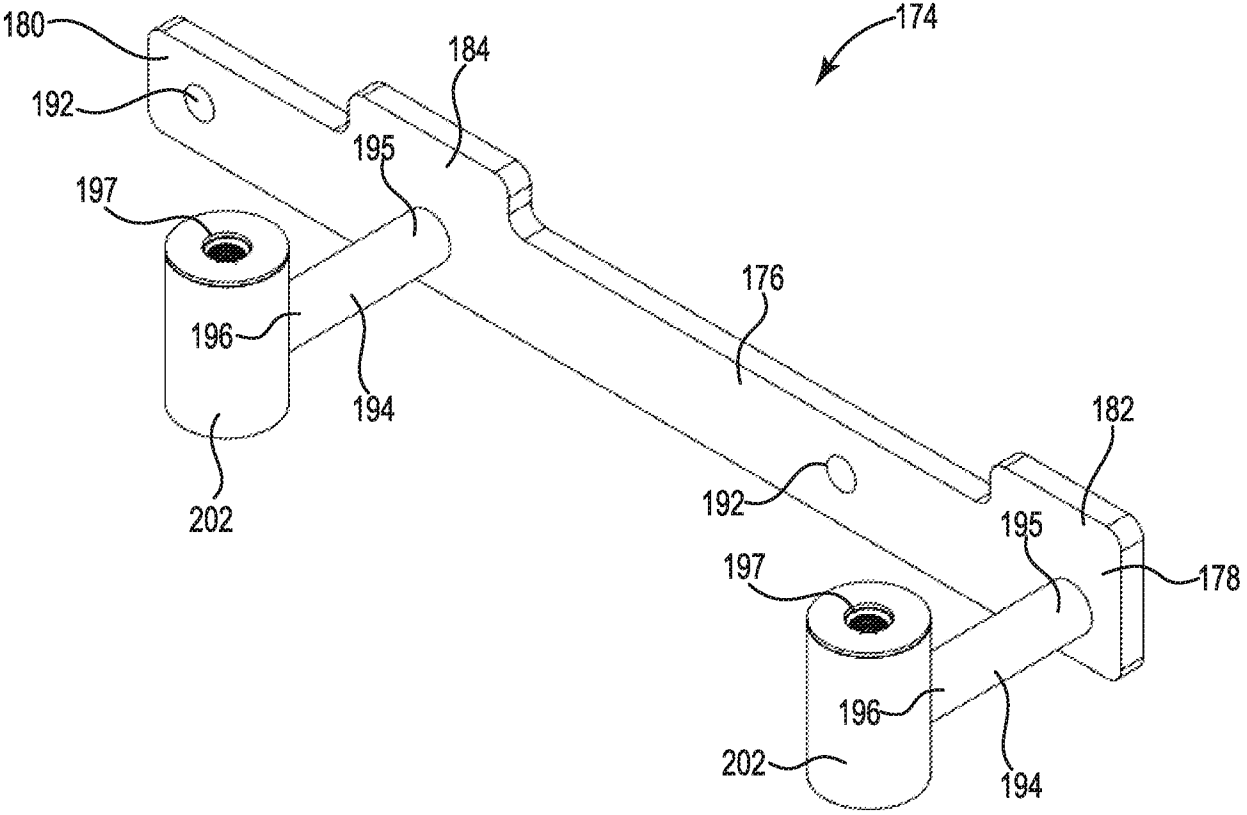
FIG. 16 is a side perspective view of a shield bracket used in a bracket assembly of FIG. 12, wherein a mirror image version of this shield bracket is used in the other bracket assembly of FIG. 12.
Figure 18:
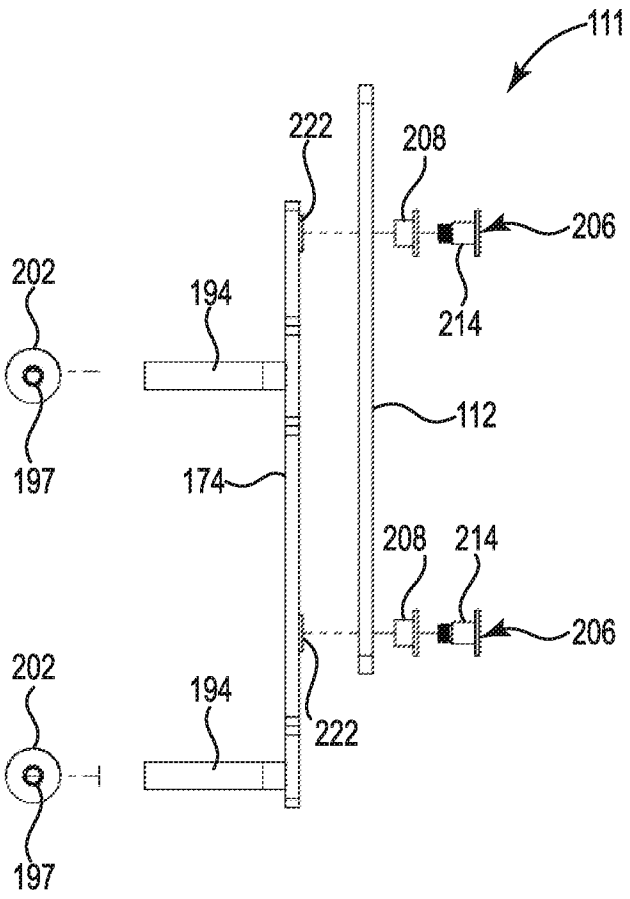
FIG. 18 is an exploded, front view of the bracket assembly shown in FIG. 17.
Figure 17:
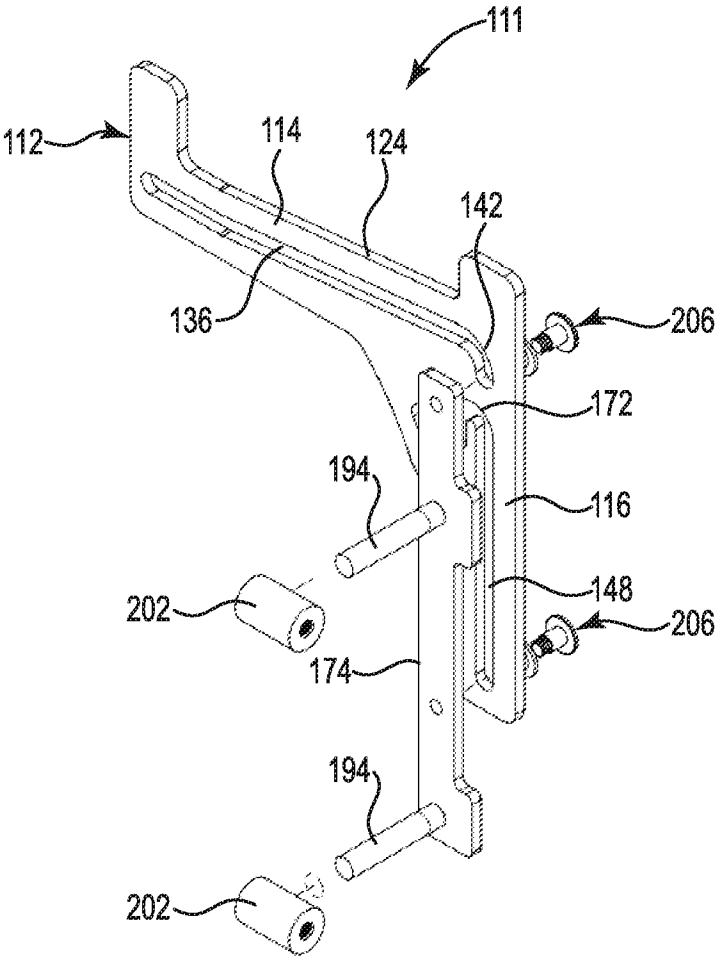
FIG. 17 is an exploded, side perspective view of one bracket assembly of the present invention of FIG. 12, wherein the other bracket assembly of FIG. 12 is a mirror image version of this bracket assembly.
Figure 20:
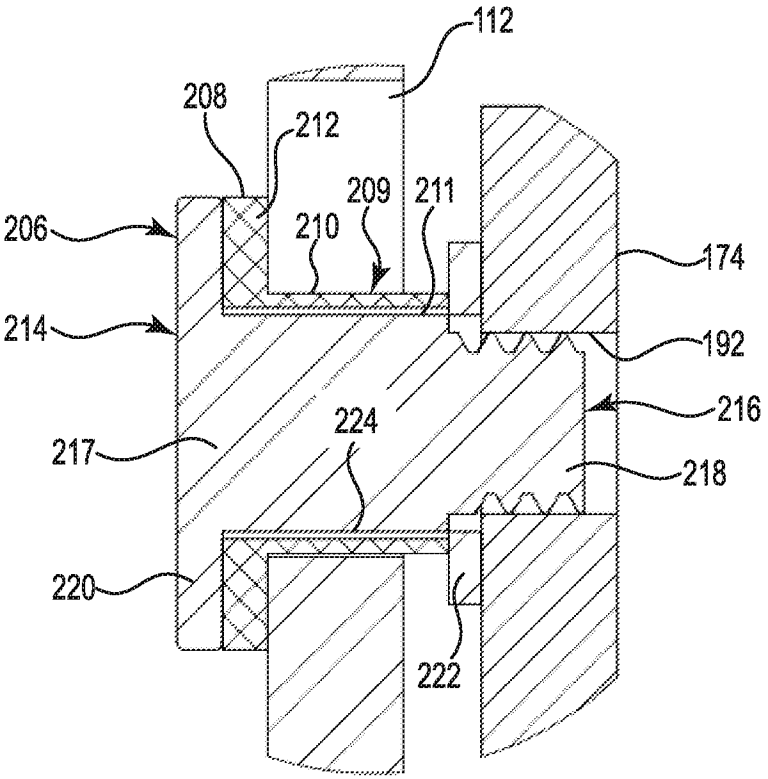
FIG. 20 is a close-up, cross section view taken from area B of FIG. 19 and that shows how a bearing stud assembly engages with the slotted hinge bracket.
Figure 19:
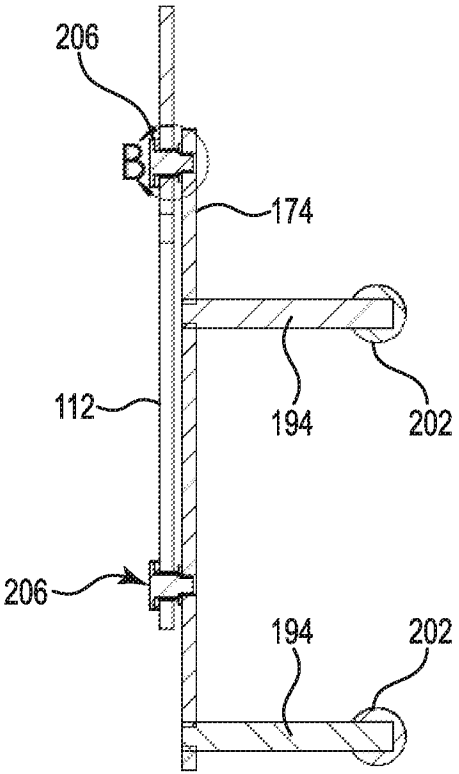
FIG. 19 is a cross-section view of the bracket assembly of FIG. 22 taken along line A-A of FIG. 22.

Features of slotted hinge bracket 112 are shown throughout the figures, but are shown in more detail in FIGS. 14 and 15. Slotted hinge bracket 112 includes body 114 formed from leg 116, arm 124, and shoulder plate 132. As illustrated, these components are integral to a single bracket plate. In some embodiments, these may be separate components that are coupled together.

Leg 116 extends from base 118 at a lower end to top end 120 proximal to shoulder plate 132. A portion of leg 116 at top end 120 projects above arm 124 in order to provide a mounting tab 122 to attach bracket 112 to support structure 44. Arm 124 extends from first end 126 proximal to shoulder plate 132 to second end 128. Mounting tab 130 extends upward from second end 128. Like mounting tab 122, mounting tab 130 also provides a surface to attach slotted hinge bracket 112 to the support structure 44. Tabs 122 and 130 can be connected to the support structure 44 in any suitable way such as glue, rivets, bolts, threaded engagement, snap-fit engagement, brazing, welding, or the like. In some embodiments, brazed or welded connections would be suitable. In other embodiments, fastening techniques are used to allow the bracket assemblies 111 to be removed or installed on demand to adjust the configuration of station 10 for different uses.

When attached to the support structure, leg 116 is positioned generally toward and along a nearby leg 60 on the front side 14 of food station 10, while the second end 128 of arm 124 is positioned relatively more in a direction toward the rear side 16 along cross beam 48. Arm 124 has a length, though, such that it only extends partway into the interior of the protective enclosure 36, and desirably less than halfway into the protective enclosure 36. Configured in this desirable way, the dimensions of food station 10 and its components are such that a second moveable and positionable shield and coupling system of the same design could be attached to the rear side 16 of station 10 to allow double sided self-serve access, if desired. The attachment of the coupling system 110 to the support structure 44 could even be removable and thus modular so that the configuration could be changed as desired to provide food station 10 with the ability to be presented as either a single sided, self-serve station or a double sided, self-serve station.

Slotted hinge bracket 112 has a slot system 134 including first slot 136 and second slot 148. The first slot 136 slideably and pivotably guides the shield bracket 174 in a manner effective to slideably and pivotably guide a rearward portion of the moveable and positionable shield 92 through the range of motion. The first slot 136 also includes features to help hold moveable and positionable shield 92 in fixed positions. First slot 136 engages a bearing surface associated with the shield bracket 174 in order to guide a rearward portion of the moveable shield 92 proximal to the trailing edge 104.

In more detail, first slot 136 has a first or leading end 138 proximal to the front side 14 of station 10 when installed in station 10. The first slot 136 also has a second end 140 proximal to the second end 128 of arm 124. A hook portion 142 of first slot 136 provides a pocket to help hold the moveable and positionable shield in a closed configuration in a manner described further below. First slot 136 has a slot axis 144 that is slanted downward in a direction from the front side 14 toward the rear side 16 at a modest angle relative to a horizontal reference line 146. In some embodiments, this downward slant may be at an angle in the range from 1 to 20 degrees below the horizontal reference line 146. The slant allows gravity to help assist in placing the moveable and positionable shield into one or more of the raised positions. At the same time, the downward slant allows gravity to help counteract the weight of shield 92 as it is lowered into a closed configuration. Counter intuitively, the result is that the shield 92 serves as its own counterweight to some degree when being raised and lowered. The apparent weight of the moveable and positionable shield 92 is less than its actual weight due to this assist.

The second slot 148 generally includes a first slot leg 150 and a second slot leg 160 joined at a rounded slot apex 172. First slot leg 150 extends from a bottom end 152 proximal to base 118 of leg 116 to a top end 154. First slot leg 150 has a slot axis 156 that is slightly canted at an angle with respect to a vertical reference line 158. The angle, $\theta$, at which the slot axis 156 is canted with respect to the vertical reference line desirably is in a range from 1 to 10 degrees. The canting of first slot leg 150 helps to make the raising and lowering action of shield 92 smoother.

Second slot 148 slideably and pivotably engages the shield bracket 174 in a manner effective to slideably and pivotably guide a leading portion of the moveable and positionable shield 92 proximal to the leading edge 102 through the range of motion. Second slot leg 160 extends from a first end 162 at apex 172 to a second end 164. Apex 172 joins second slot leg 160 and first slot leg 150 with a smooth contour configured to provide a smooth range of motion as a bearing surface on the shield bracket 174 is guided from first slot leg 150 into second slot leg 160 and vice versa.

Second slot leg 160 has a slot axis 170 that is oriented at an acute angle, $\Phi$, with respect to slot axis 156 of the first slot leg 150. In representative modes of practice this acute angle, $\Phi$, is in the range from 20 degrees to 80 degrees, more preferably 25 degrees to 60 degrees. Additionally, slot axis 170 is nonparallel with respect to slot axis 144 of the first slot 136 and further is slanted even more steeply downward with respect to the horizontal reference line 146 as compared to slot axis 144.

This downward slant configuration of second slot leg 160 helps to lower and more securely position moveable and positionable shield 92 into one or more, fixed, raised configurations. Second slot leg 160 includes one or more features that help to position moveable and positionable shield 92 in these one or more raised positions. In representative embodiments, such features may include one or more pockets into which engaged portion(s) of the shield bracket 174 can be lowered and captured to hold the leading edge 102 of shield 92 in a desired raised position. For purposes of illustration, second slot leg 160 is configured with two such pockets 166 and 168 corresponding to first and second raised positions, respectively. First pocket 166 extends downward from second slot leg 160 in a manner such that the first pocket 166 is generally parallel to the first slot leg 150. Second pocket 168 is both deeper and canted inward in a non-parallel fashion toward the first slot leg 150. Other embodiments of second slot leg 160 may be configured with only one pocket corresponding to a single raised shield position, or with three or more pockets to provide 3 or more corresponding raised configurations.

The coordinated guidance provided by the slots 136 and 148 provides easy and smooth operation when raising and lowering shield 92. The hook 142 and pockets 166 and 168, in cooperation with gravity, provide firm, fixed positions. The "reverse J" configuration of second slot 148, for instance, helps to prevent accidental shutting of shield 92 when shield 92 is fixed in one of the two open positions. In order to close the shield 92 from one of the open positions, in a first stage, the user would have to lift up on shield 92 while also pushing the shield 92 further back into slot 136. Thereafter, in a second stage, with the corresponding bearing surface of the bearing study assembly in slot 148 free of the pocket 166 or 168, the user could only then lower shield 92 to the closed configuration. The downward slant of slot 136 helps ease the motion as shield 92 is lowered. In effect, the slot and pocket design incorporated into the slotted hinge bracket 112 incorporates a two-stage mechanism that holds the shield 92 in an open configuration.

The downward slope of the second slot leg 160 helps to establish more secure, open positions as well. This slope prevents a mere pull from being able to close the shield 92 from an open configuration. The slot design also contributes to the function that closing the shield 92 requires that the shield 92 is lifted and pushed back and only then lowered to close the shield 92.

The shield bracket 174 is generally shown throughout the figures but is shown in more detail in FIGS. 16 through 22 and 27 to 28. Shield bracket 174 generally includes body 176, pins 194, standoffs 202, and bearing stud assemblies 206. Body 176 extends from a first or leading end 178 to a second or trailing end 180. First end 178 generally is relatively proximal to the leading edge 102 of shield 92, while second end 180 is relatively proximal to the trailing edge 104 of shield 92. Body 176 preferably has wider portions 182 and 184 that help to strengthen and stiffen body 176 at sites where body 176 will be coupled to moveable and positionable shield 92 via pins 194 and mounting members or standoffs 202. Moveable and positionable shield 92 includes apertures configured to accommodate hardware 95, such as bolts, machine screws, rivets, or the like, that attach shield 92 to the standoffs 202.

As seen best in FIGS. 16 to 22, each pin 194 includes a first end 195 attached to body 176 by any suitable fastening technique. Second ends 196 of pins 194 are attached to corresponding standoffs 202 by any suitable fastening technique. Standoffs 202 include an aperture for attachment to a corresponding pin 194 and an aperture 197 to receive hardware to attach each standoff 202 to shield 92. Examples of suitable fastening techniques used to assemble the components of shield bracket 174 include threaded engagement, bolts, machine screws, glue, brazing, welding, combinations of these, and the like.

Details of the bearing stud assemblies 206 incorporated into shield bracket 174 are best shown in FIGS. 17 to 20. On each of ends 98 and 100 of moveable and positionable shield 92, shield bracket 174 incorporates a bearing stud assembly 206 that helps to guide a leading portion of shield 92 proximal to leading edge 102 and an additional bearing stud assembly 206 that helps to guide a trailing portion of shield 92 proximal to trailing edge 104. On each of ends 98 and 100, the bearing stud assembly 206 proximal to leading edge 102 is slideably and pivotably guided by the second slot 148. While the bearing stud assembly proximal to trailing edge 104 is slideably and pivotably guided by the first slot 136. In practical effect, this configuration means that the first slots 136 in the bracket assemblies 111 guide the rearward portion of shield 92 while the second slots 148 of bracket assemblies 111 guide the leading portion of shield 92.

Each bearing stud assembly 206 generally includes a sleeve washer 208, stud pin 214, and an additional washer 222. Sleeve washer 208 includes a shaft 209 and head 212. Sleeve washer advantageously is made from a material such as nylon to provide a low friction engagement with the slots 136 and 148. The entire assembly 206 also is easy to clean, is durable and long-lasting, and does not need lubrication that otherwise could generate contamination of a food supply. Shaft 209 includes outer bearing surface 210 that slideably and pivotably engages a corresponding slot in the corresponding slotted hinge bracket 112. A through bore 211 extends though sleeve washer 208. Stud pin 214 includes a shaft 216 and a head 220. Base 217 of shaft 216 is configured to slideably and rotatably fit inside through bore 211. Threaded end 218 is configured to threadably engage threaded mounting apertures 192 in the body 176 of shield bracket 174.

To couple the brackets 112 and 174 to form an assembled bracket assembly 111, a sleeve washer 208 is fitted though each slot 136 and 148 of a corresponding slotted hinge bracket 112. The outer bearing surface 210 of each shaft 209 of a sleeve washer 208 is sized to provide a small clearance gap 224 (FIG. 20) with its corresponding slot so that the bearing surface 210 can slide and pivot freely without undue friction while at the same time minimizing too much free play so that movement of a bearing stud assembly 206 within its corresponding slot is smooth and precise. A stud pin 214 is then inserted through each of the sleeve washers 208, with the threaded end 218 of each stud pin 214 being threaded into a corresponding aperture 192 in the body 176 of the shield bracket 174 through a corresponding washer 222. As the threaded end 218 of the stud pin 214 is tightened in the aperture 192, the wider base 217 clamps against the washer 222 and surface of body 176.

During assembly of each corresponding pair of slotted hinge bracket 112 and shield bracket 174, one such bearing study assembly 206 associated with the leading edge 102 of the shield 92 is fit through the second slot 148 of the slotted hinge bracket 112. A second bearing stud assembly 206 associated with the trailing edge 104 of the shield 92 is fit through the first slot 136 of the slotted hinge bracket 112.

This assembly configuration allows each shield bracket 174, and hence the moveable and positionable shield 92 attached to the shield brackets 174, to move through a range of motion relative to the slotted hinge bracket 112. The bearing stud assemblies 206 of each shield bracket 174 are guided in coordinated fashion by the slots 136 and 148 in the slotted hinge bracket 112. For example, as the bearing stud assembly 206 coupled to a second slot 148 is lifted up the first slot leg 150, though the apex 172, and then down the second slot leg 160, the bearing stud assembly 206 coupled to the first slot 136 traverses rearward in a coordinated fashion along the first slot 136 in a direction generally from the front side 14 of station 10 to the rear side 16. Similarly, as the bearing stud assembly 206 coupled to a second slot 148 is lifted up the second slot leg 160, though the apex 172, and then down the first slot leg 150, the bearing stud assembly 206 coupled to the first slot 136 traverses forward in a coordinated fashion along the first slot 136 in a direction generally from the rear side 16 of station 10 to the front side 14.

Figure 22:
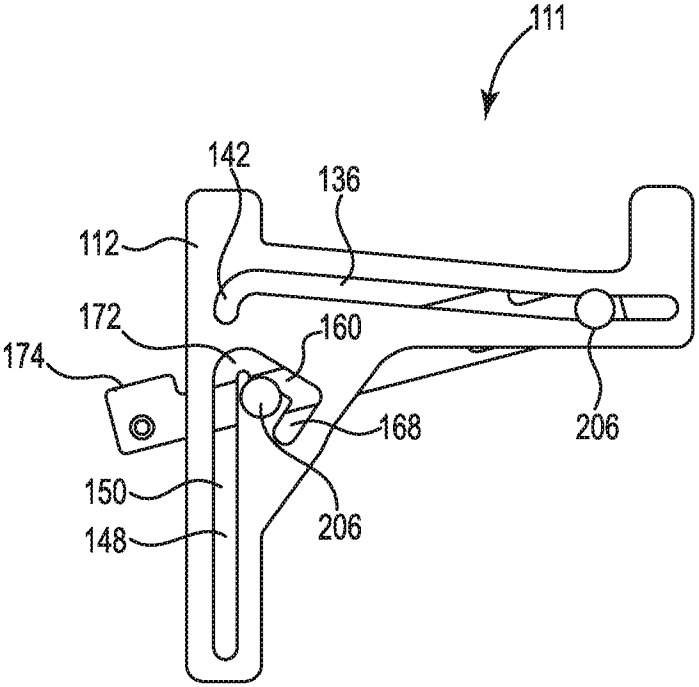
FIG. 22 is a side view of the bracket assembly configuration shown in FIG. 21.
Figure 21:
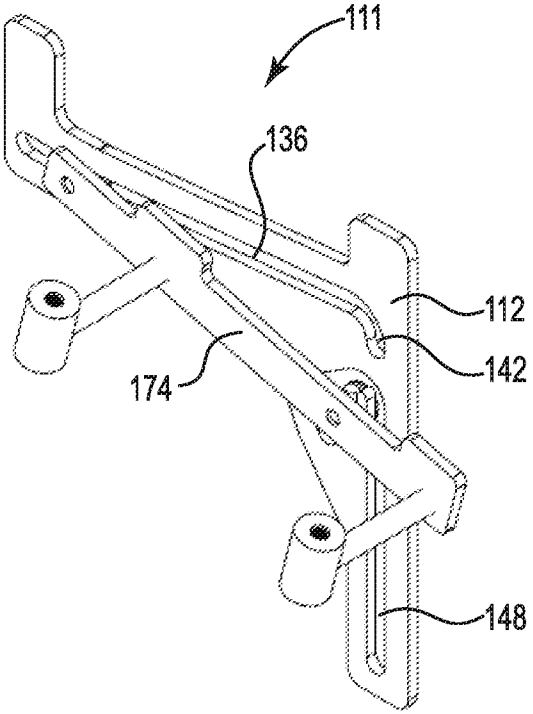
FIG. 21 is a side perspective view of the bracket assembly of FIG. 17 showing the assembly in a configuration in which the moveable and positionable shield is in one of two available raised position to allow self-serve access to a food supply held in the food station of FIG. 1.
Figure 24:
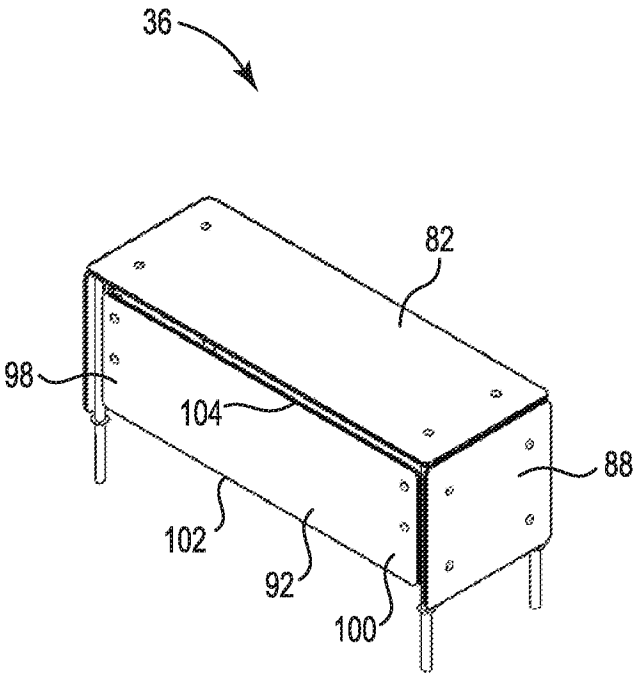
FIG. 24 is a front perspective view of the protective enclosure in the closed configuration of FIG. 23.
Figure 23:
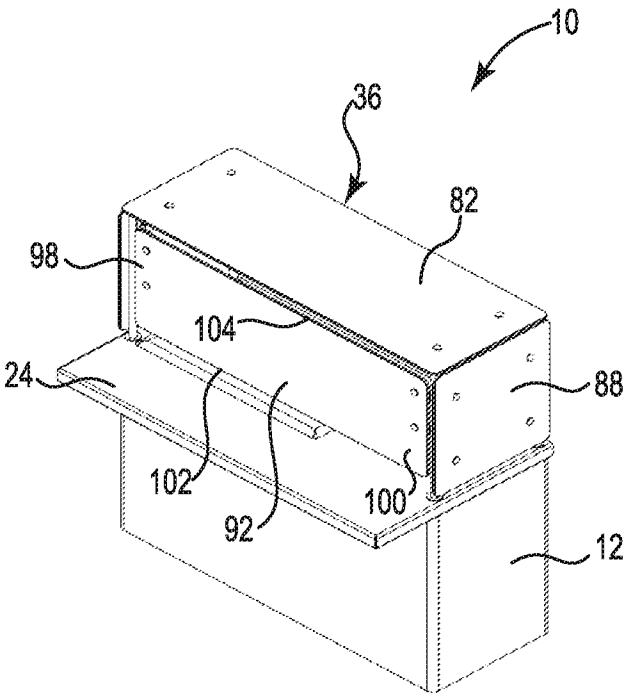
FIG. 23 is a front perspective view of the food station of FIG. 1 in which the moveable and positionable shield is lowered into a closed configuration to prevent self-serve access to the food supply held in the food station of FIG. 1.
Figure 26:
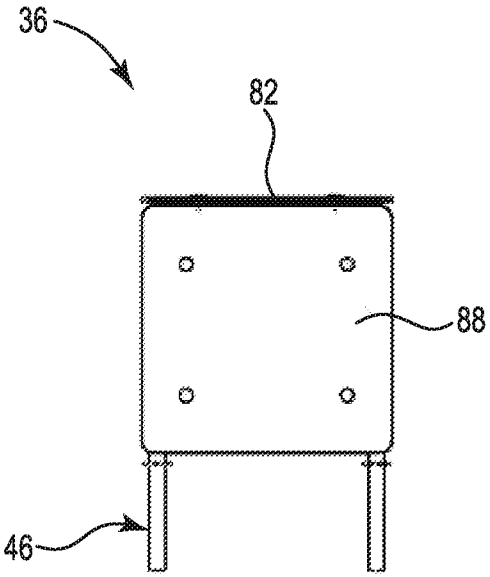
FIG. 26 is a side view of the protective enclosure in the closed configuration of FIG. 23.
Figure 25:
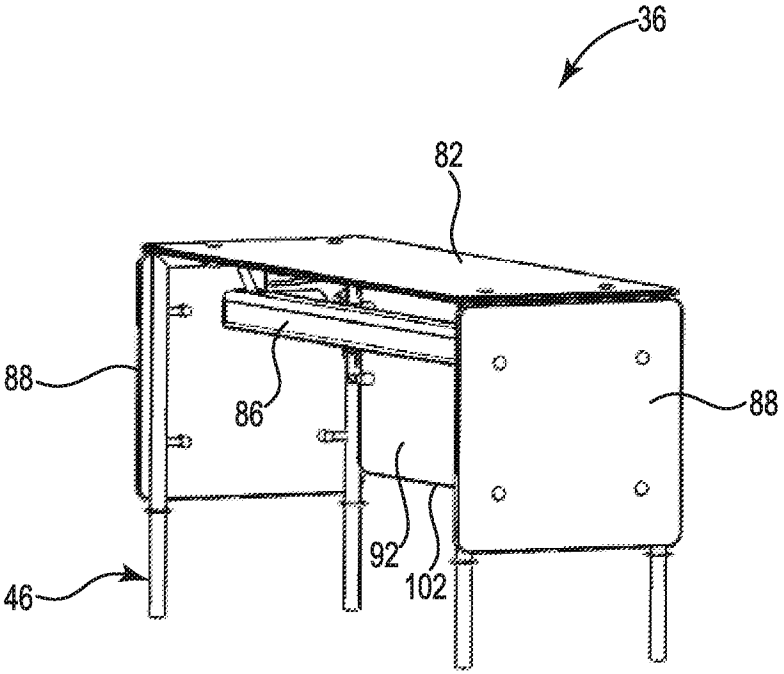
FIG. 25 is a rear perspective view of the protective enclosure in the closed configuration of FIG. 23.

FIGS. 21 to 30 show in more detail how the coordinated movement of bearing stud assemblies 206 in slots 136 and 148 allow the moveable and positionable shield 92 to be moved through a range of motion and positioned in raised and lowered positions. Referring first to FIGS. 21 and 22, a bracket assembly 111 is in a configuration in which the moveable shield is in a fixed, raised position corresponding to the configuration of food station 10 shown in FIGS. 1 to 8. In this configuration, a first bearing stud assembly 206 proximal to the leading edge 102 of shield 92 is lowered into and held in pocket 166. In the meantime, a second bearing stud assembly 206 more proximal to the trailing edge 104 is positioned towards and supported by a rearward portion of first slot 136. In this configuration, gravity holds the first bearing stud assembly 206 in pocket 166. This maintains the shield 92 in this raised, open configuration unless the first bearing stud assembly 206 is lifted out of pocket 166 so that the first bearing stud assembly could then be moved deeper into the second slot leg 160 or forward and down the first slot leg 150. For extra security in holding the bearing stud assembly 206 in pocket 166, a latch, chain, pin, depressible button, or the like may be used if desired to restrain the assembly 206 in the pocket 166 unless the security is released. Another, similar raised, open configuration (See FIGS. 27 and 28) could be achieved by placing the first bearing stud assembly 206 into the second pocket 168.

Different raised configurations may be desirable depending upon how food station 10 is to be used. For example, in some locations, the positioning and use of protective enclosures is subject to specific regulations. For example, the NSF standards (promulgated by NSF International, a public health and safety organization) are one set of rules that may apply to food service operations in the United States. There also may different versions of regulations that may be applicable. For example, one version of NSF standards may be applicable to one food setting, while a different version of NSF standards may be applicable to another food setting. Having multiple pockets such as pockets 166 and 168 allows protective enclosure 36 to be useful in different settings without having to change hardware or secure a different food station. The use of multiple pockets is optional, however, and some embodiments of food station 10 may include only one pocket configuration suitable for a desired use.

Figure 28:
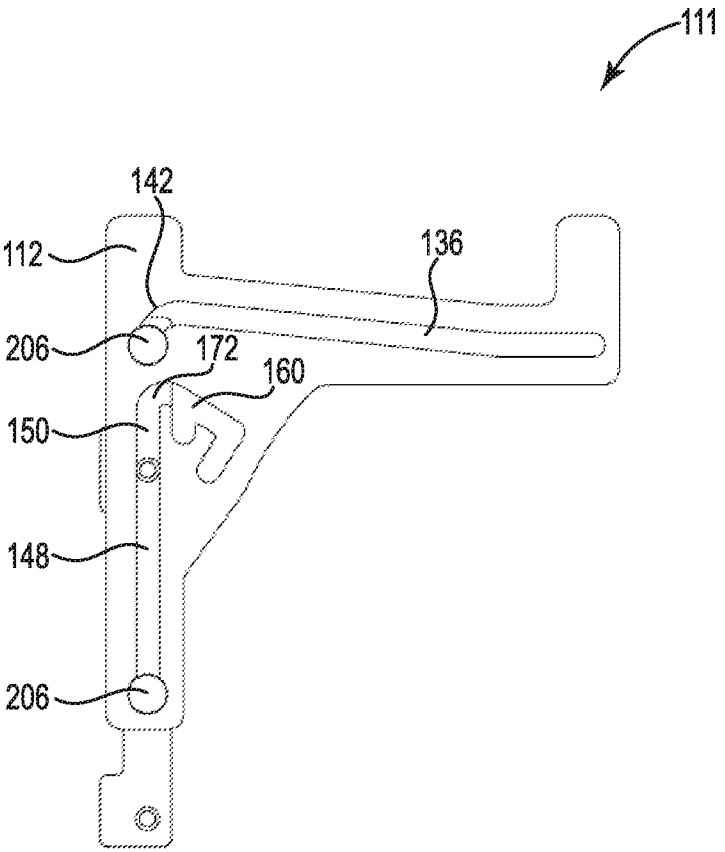
FIG. 28 is a side view of the bracket assembly configuration shown in FIG. 27.
Figure 27:
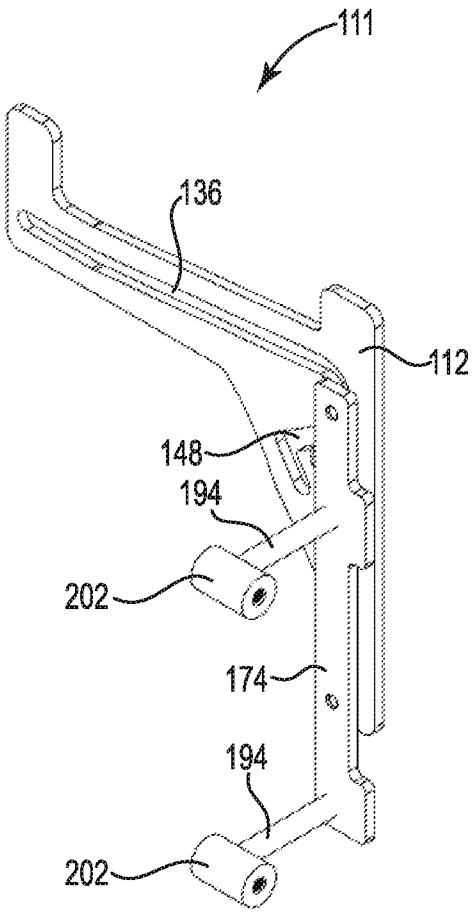
FIG. 27 is a side perspective view of the bracket assembly of FIG. 17 showing the assembly in a configuration in which the moveable and positionable shield is in a closed position as shown in FIG. 23 to prevent self-serve access to a food supply held in the food station of FIG. 29.
Figure 30:
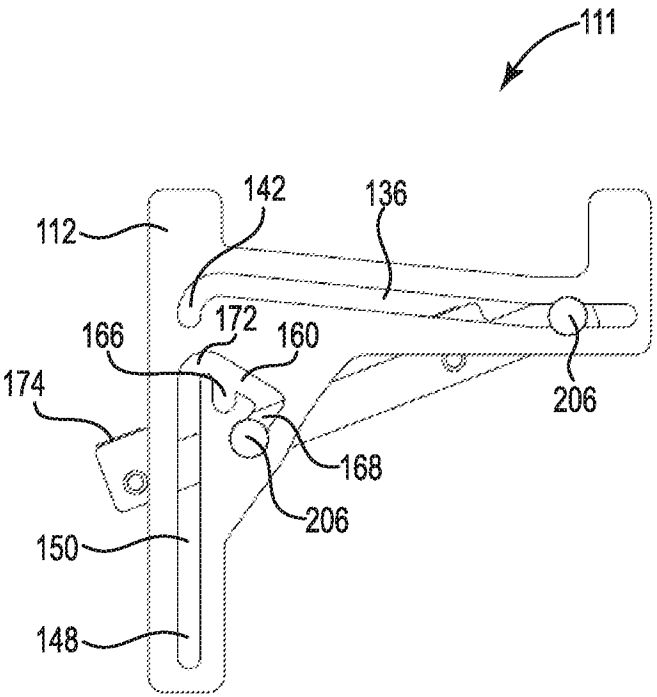
FIG. 30 is a side view of the bracket assembly configuration shown in FIG. 29.
Figure 29:
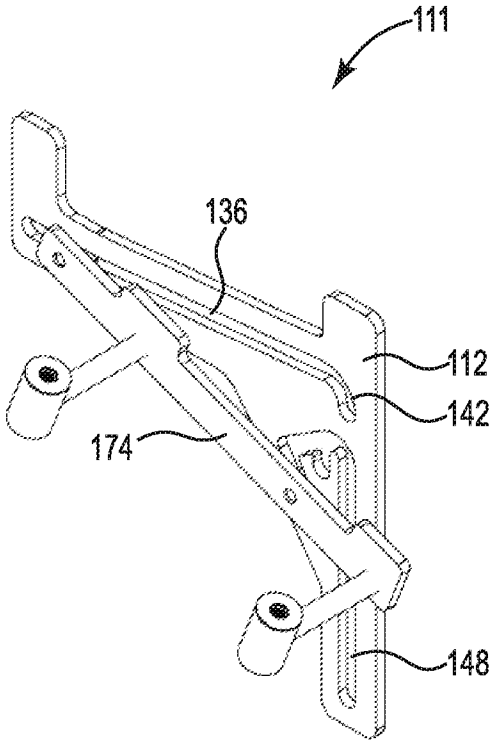
FIG. 29 is a side perspective view of the bracket assembly of FIG. 17 showing the assembly in an alternative configuration in which the moveable and positionable shield is in the open position.

FIGS. 23 to 30 show in more detail another manner by which the coordinated movement of bearing stud assemblies 206 in slots 136 and 148 allow the moveable and positionable shield 92 to be moved through a range of motion and positioned in a lowered position. Referring first to FIGS. 27 and 28, a bracket assembly 111 is in a configuration such that a first bearing stud assembly 206 proximal to the leading edge 102 of shield 92 is lowered into the first slot leg 150 and supported at the bottom end 152. In the meantime, a second bearing stud assembly 206 engaged with the first slot 136 is positioned forward and captured at the bottom of the pocket or hook 142 in the leading end 138. In this configuration, gravity holds the second bearing stud assembly 206 in pocket 142 while the first bearing stud assembly 206 is kept from swinging side to side by the constraints of first slot leg 150. This maintains the shield 92 in this lowered, closed configuration unless the second bearing stud assembly 206 is lifted out of pocket 142 so that the second bearing stud assembly 206 could then be moved further back into the first slot 136. For extra security in holding the bearing stud assembly 206 in pocket 142, a latch, chain, pin, depressible button, or the like may be used if desired to restrain the assembly 206 in the pocket 142 unless the security is released. FIGS. 23 to 26 show how the moveable and positionable shield 92 is lowered and blocks access to the interior of protective enclosure 36 in this configuration.

Figure 1:
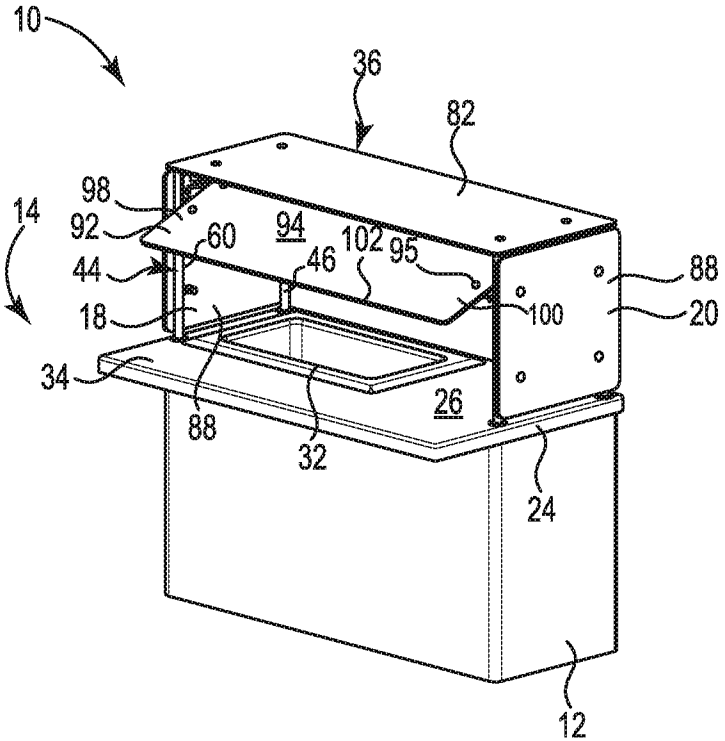
FIG. 1 is a perspective front view of a self-serve food station having a protective enclosure to guard a food supply, wherein the protective enclosure incorporates principles of the present invention to provide a moveable and positionable shield panel.
Figure 4:
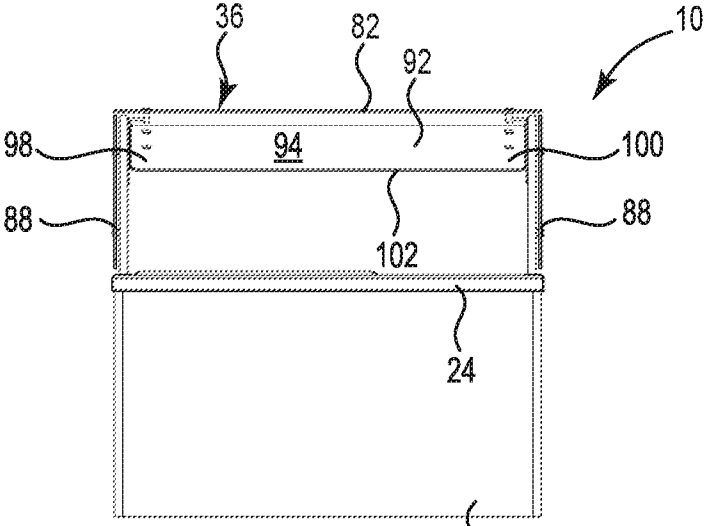
FIG. 4 is a front view of the self-serve food station of FIG. 1.
Figure 5:
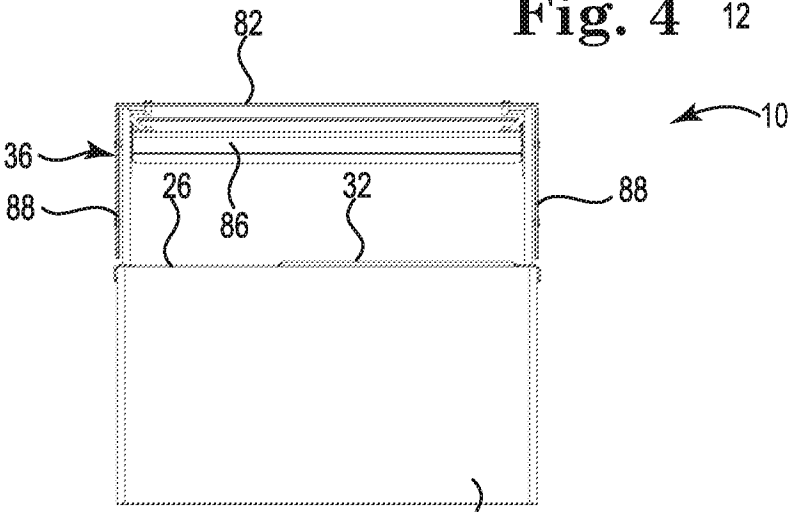
FIG. 5 is a rear view of the self-serve food station of FIG. 1.
Figure 3:
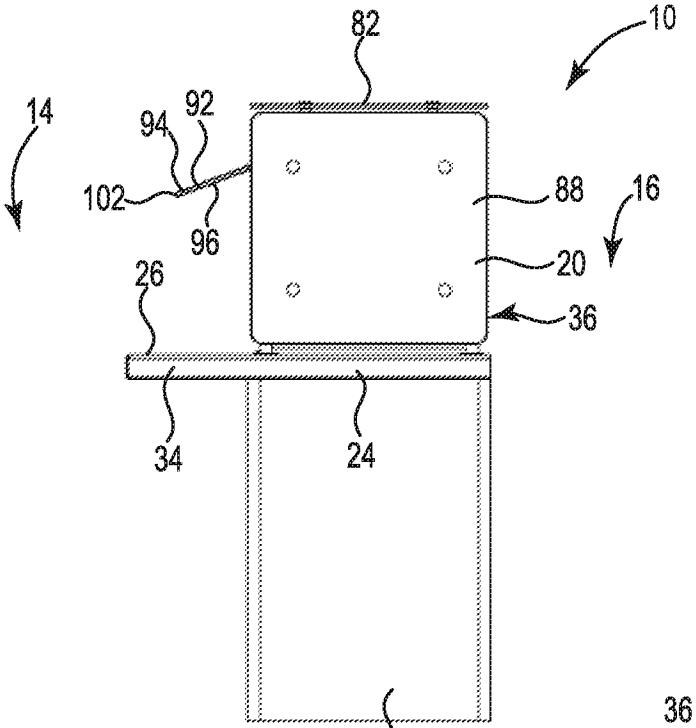
FIG. 3 is a side view of the self-serve food station of FIG. 1.
Figure 7:
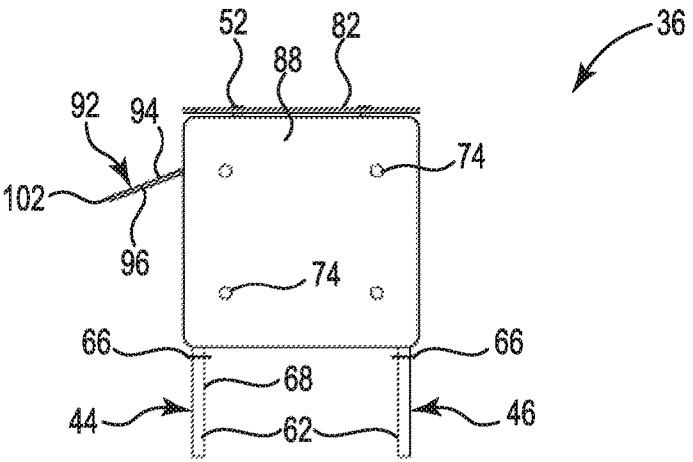
FIG. 7 is a side view of the protective enclosure of FIG. 6.
Figure 6:
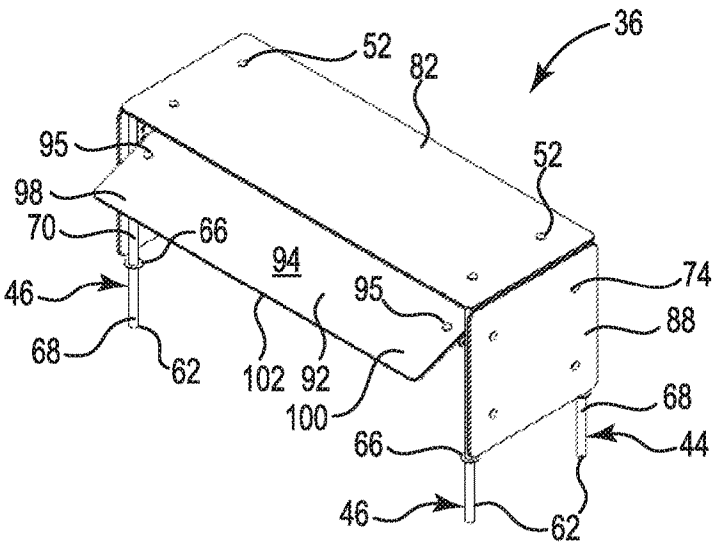
FIG. 6 is a top perspective view of the protective enclosure
Figure 8:
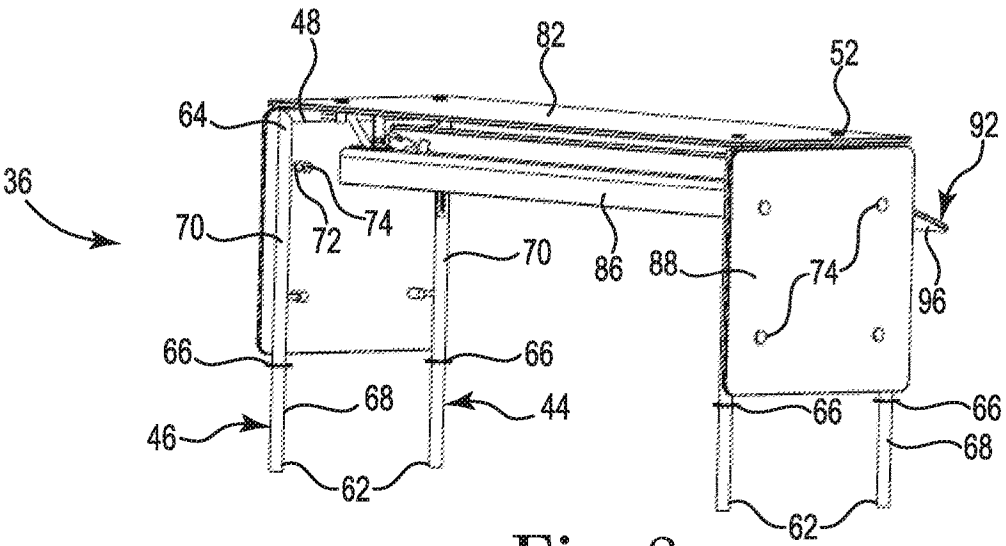
FIG. 8 is a rear perspective view of the protective enclosure of FIG. 6.
Figure 10:
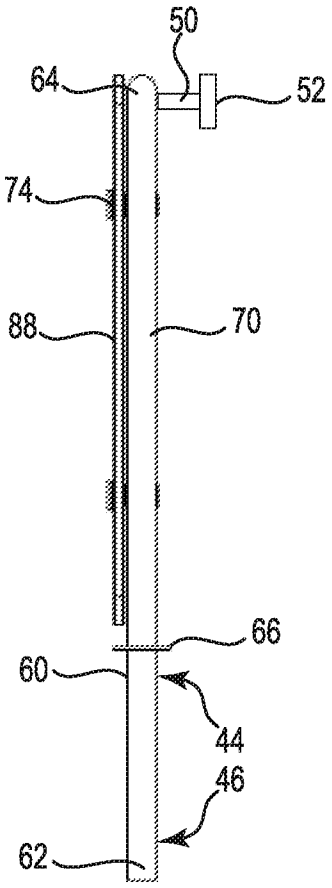
Figure 11:
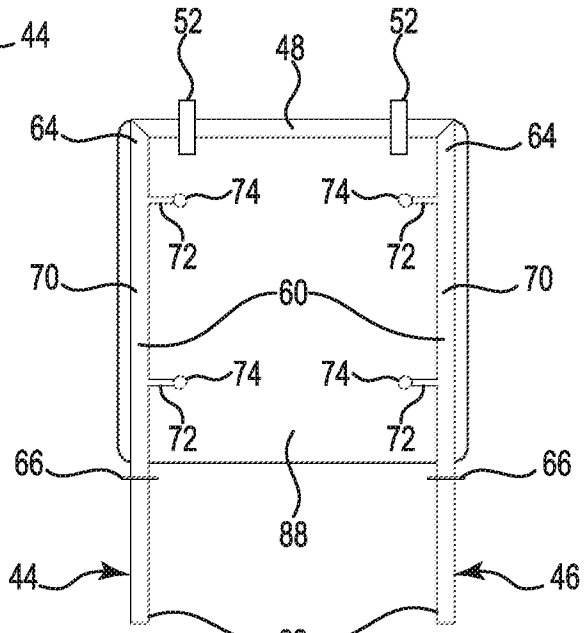
FIG. 11 is an alternative view of the end panel assembly of FIG. 9 viewed face on from inside the enclosure.
Figure 9:
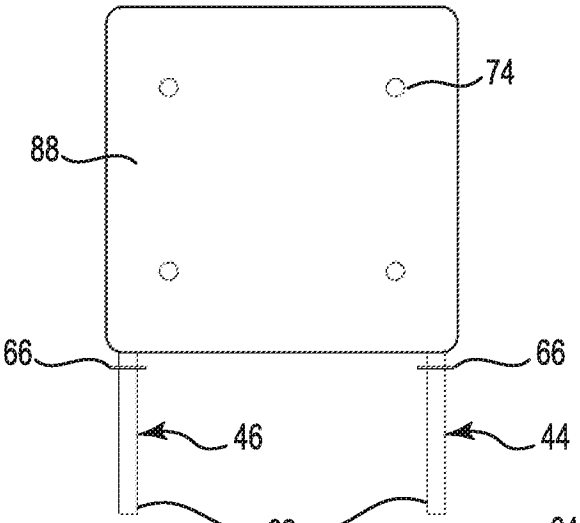
FIG. 9 is a side view of a portion of the protective enclosure of FIG. 6 showing an end panel of the enclosure viewed face-on from outside the enclosure.
Figure 12:
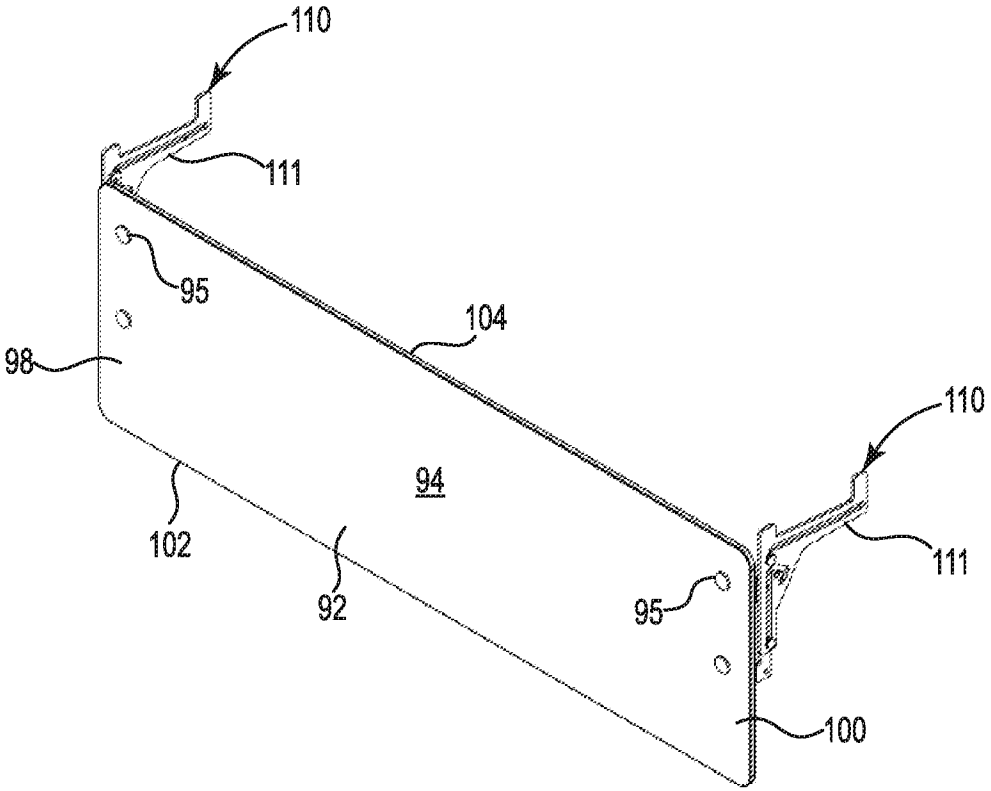
FIG. 12 is a front perspective view of a portion of the protective enclosure of FIG. 6 showing the moveable and positionable shield attached to the coupling system (in the form of bracket assemblies in this embodiment) of the present invention that help to provide the shield with moveable and positionable functionality.
Figure 13:
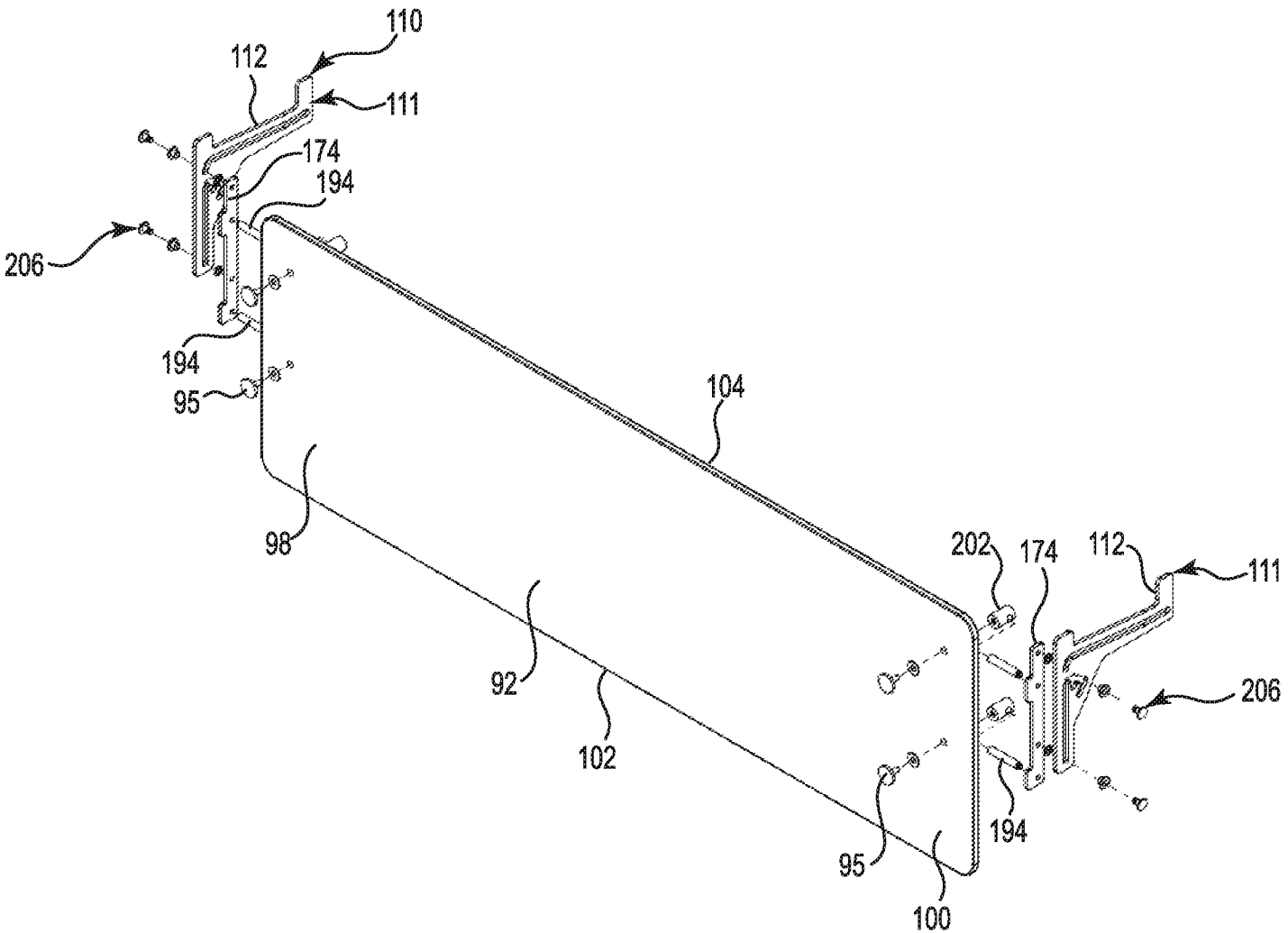
FIG. 13 is an exploded perspective view of the moveable and positionable shield and bracket assemblies shown in FIG. 12.
Figure 32:
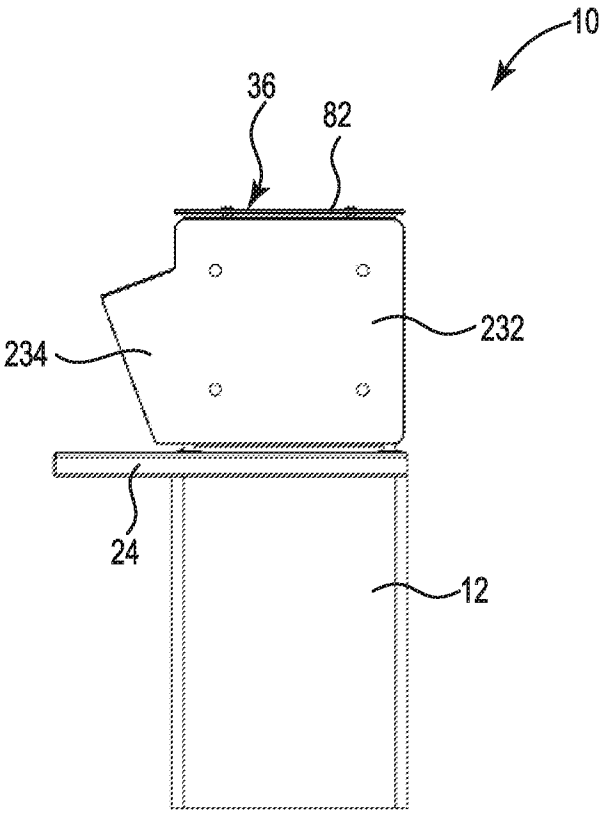
FIG. 32 is a side view of the embodiment of a food station shown in FIG. 31.
Figure 31:
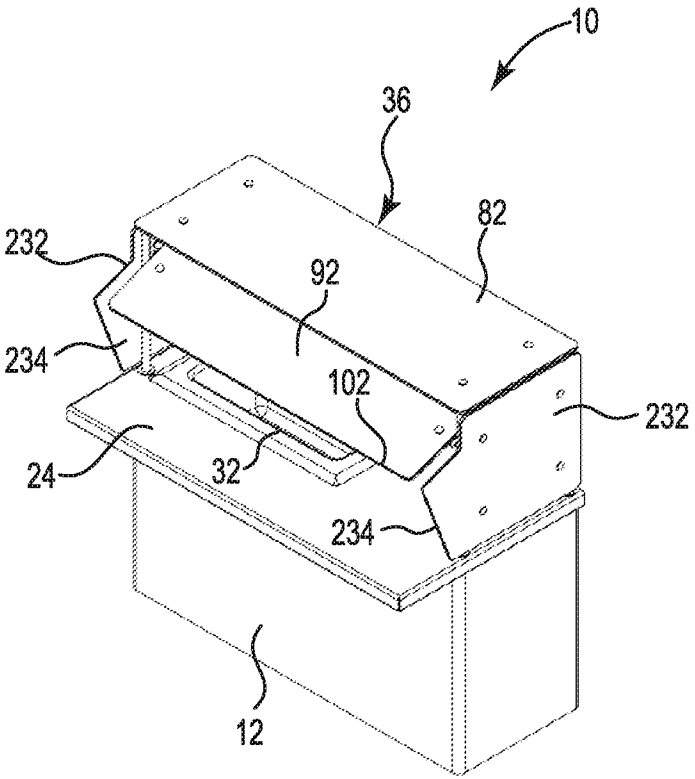
FIG. 31 is a front perspective view of an alternative embodiment of a food station incorporating principles of the present invention in which the side panel assemblies of the protective enclosure are extended to provide a larger side barrier to protect a food supply when the moveable and positionable shield is in a raised configuration.

An optional modification of food station 10 is shown in FIGS. 31 and 32 that enhances the ability of protective enclosure 36 to form a barrier against airborne contamination. Referring first to the embodiment of station 10 shown in FIG. 1, the moveable and positionable shield 92 extends outward toward front side 14 beyond the barrier protection provided by side panels 88. Food station 10 is modified to augment the barrier protection under the raised shield 92. To this end, side panels 88 of FIG. 1 are replaced with side panels 232 that include extension wings 234 to more fully establish a side barrier when shield 92 is raised. Extension wings 234 are shown as being integral with side panels 232, but these may be separate components that may be installed or removed on demand.

All patents, patent applications, and publications cited herein are incorporated herein by reference in their respective entities for all purposes. The foregoing detailed description has been given for clarity of understanding only. No unnecessary limitations are to be understood therefrom. The invention is not limited to the exact details shown and described, for variations obvious to one skilled in the art will be included within the invention defined by the claims.

What is claimed is:

1. A protection system, comprising:

a) a support structure;

b) a protective enclosure comprising a moveable and positionable shield, said moveable and positionable shield comprising a first edge, a second edge, a first shield end, and a second shield end, wherein each of the first and second shield ends is slideably and pivotably coupled to the support structure in a manner such that the moveable and positionable shield slides and pivots to be raised and lowered in a range of motion that comprises two or more stationary positions comprising at least a lowered shield position and a raised shield position;

c) a first bracket assembly that slideably and pivotably couples the first shield end to the support structure, the first bracket assembly comprising:

a first bracket fixedly coupled to the support structure, the first bracket comprising a first slot and a second slot separate from the first slot, the second slot having a different shape than the first slot; and a second bracket comprising a first bearing surface that slideably and pivotably engages the first slot and a second bearing surface that slideably and pivotably engages the second slot; and d) a second bracket assembly that slideably and pivotably couples the second shield end to the support structure, wherein the first and second bracket assemblies cooperatively guide the first and second shield ends in a manner such that raising the first edge of the moveable and positionable shield results in a countermove lowering of the second edge of the moveable and positionable shield.

2. The protection system of claim 1, wherein the second bracket is fixedly coupled to the first shield end.

3. The protection system of claim 1, wherein the first bracket includes a leg and an arm, wherein the arm is attached to the leg at a front side and extends from the leg to a rear side.

4. The protection system of claim 3, wherein a portion of the leg projects above the arm.

5. The protection system of claim 3, wherein the first bracket further comprises a shoulder plate.

6. The protection system of claim 3, wherein the protection system provides a protective enclosure, and wherein the arm has a length that extends only partway into an interior of the protective enclosure.

7. The protection system of claim 3, wherein the first slot extends along the arm and has a slot axis that is slanted downward in a direction from the front side to the rear side.

8. The protection system of claim 7, wherein the slot axis of the first slot is slanted downward at an angle in the range from 1 to 20 degrees.

9. The protection system of claim 6, wherein the first slot has a hook portion at the front side.

10. The protection system of claim 3, wherein the second slot includes a first slot leg and a second slot leg, wherein the first and second slot legs are joined at a rounded slot apex.

11. The protection system of claim 10, wherein the first slot leg of the second slot extends from a bottom end proximal to a base of the leg to a top end at the apex, and wherein the second slot leg of the second slot extends from the apex from a first end to a second end.

12. A food and/or beverage station, comprising:

a) a countertop;

b) a base supporting the countertop; and c) a protection system of claim 1 incorporated into the food and/or beverage station in a manner such that the protection system provides a barrier between the countertop and at least a portion of the ambient environment.

13. The protection system of claim 1, wherein the second slot includes a pocket positioned between a first end and a second end of the second slot, the pocket being configured to receive the second bearing surface to hold an edge of the moveable and positionable shield in a first position.

14. The protection system of claim 13, wherein the pocket is a first pocket and wherein the second slot includes a second pocket, the second pocket being configured to receive the second bearing surface to hold the edge of the moveable and positionable shield in a second position.

15. The protection system of claim 14, wherein the second slot includes a first slot leg and a second slot leg, and wherein the first slot leg, the first pocket, and the second pocket extend downward from the second slot leg.

16. A protection system, comprising:

a) a support structure;

b) a protective enclosure comprising a moveable and positionable shield, said moveable and positionable shield comprising a first edge, a second edge, a first shield end, and a second shield end, wherein each of the first and second shield ends is slideably and pivotably coupled to the support structure in a manner such that the moveable and positionable shield slides and pivots to be raised and lowered in a range of motion that comprises two or more stationary positions comprising at least a lowered shield position and a raised shield position;

c) a first bracket assembly that slideably and pivotably couples the first shield end to the support structure; and d) a second bracket assembly that slideably and pivotably couples the second shield end to the support structure, wherein the first and second bracket assemblies cooperatively guide the first and second shield ends in a manner such that raising the first edge of the moveable and positionable shield results in a countermove lowering of the second edge of the moveable and positionable shield; and wherein each of the first and second bracket assemblies comprises:

a slotted hinge bracket comprising first and second slots, the second slot including a first slot leg and a second slot leg that are joined at a rounded slot apex, wherein the first slot leg of each of the second slots of the slotted hinge brackets extends from a bottom end proximal to a base of the slotted hinge bracket to a top end at the apex, wherein the second slot leg of each of the second slots extends from the apex from a first end to a second end, and wherein the first slot leg of each of the second slots has a slot axis that is canted at angle in the range from 1 to 10 degrees with respect to a vertical reference line; and a shield bracket comprising first and second bearing surfaces, said bearing surfaces slideably and pivotably coupling the shield bracket to the corresponding slotted hinge bracket, wherein the first and second bearing surfaces of the corresponding shield bracket slideably and pivotably engage the first and second slots of the corresponding slotted hinge bracket.

17. The protection system of claim 16, wherein each of the second slot legs of the second slots has a slot axis that is at an acute angle with respect to the slot axis of the corresponding first slot leg, and wherein the slot axis of each of the second slot legs is slanted downward more steeply than the slot axis of the corresponding first slot leg.

18. The protection system of claim 17, wherein each of the second slot legs comprises a pocket into which the second bearing surface on the corresponding shield bracket can be lowered and captured to help hold an edge of the moveable and positionable shield in a raised position.

19. The protection system of claim 17, wherein each of the second slot legs comprises a second pocket in to which the second bearing surface on the corresponding shield bracket can be lowered and captured to help hold an edge of the moveable and positionable shield in a second raised position.

20. A protection system, comprising:

a) a support structure;

b) a protective enclosure comprising a moveable and positionable shield, said moveable and positionable shield comprising a first shield end and a second shield end, wherein each of the first and second shield ends is slideably and pivotably coupled to the support structure in a manner such that the moveable shield comprises a range of motion in which the shield slides and pivots to be raised and lowered in a range of motion that comprises two or more stationary positions;

c) a first bracket assembly that slideably and pivotably couples the first shield end to the support structure; and d) a second bracket assembly that slideably and pivotably couples the second shield end to the support structure, wherein each of the first and second bracket assemblies comprises first and second slots, a first slideable and pivotable bearing surface that engages the first slot, and a second slideable and pivotable bearing surface that engages the second slot, and wherein the first and second slots of each of the bracket assemblies cooperatively guide the corresponding first and second bearing surfaces as the moveable and positionable shield is raised and lowered in the range of motion;

wherein the first slot of each bracket assembly slideably and pivotably engages the corresponding first slideable and pivotable bearing surface in a manner effective to slideably and pivotably guide a rearward portion of the moveable and positionable shield, and wherein the first slot includes a first slot axis that is sloped downward at an angle relative to a horizontal reference line; and wherein the second slot slideably and pivotably engages the corresponding second slideable and pivotable bearing surface in a manner effective to slideably and pivotably guide a leading portion of the moveable and positionable shield, and wherein the second slot comprises first and second slot legs acutely joined proximal to the top of the first slot leg at an apex, wherein the first slot leg is substantially vertical and the second slot leg has a second slot leg axis that is sloped downward relative to the horizontal reference line more steeply than the first slot axis.

21. A food and/or beverage station, comprising:

a) a countertop;

b) a base supporting the countertop; and c) a protection system of claim 18 incorporated into the food and/or beverage station in a manner such that the protection system provides a barrier between the countertop and at least a portion of the ambient environment.

* * * * *